US011495171B2

(12) United States Patent
Kim et al.

(10) Patent No.: US 11,495,171 B2
(45) Date of Patent: Nov. 8, 2022

(54) DISPLAY MODULE AND DRIVING METHOD THEREOF

(71) Applicant: SAMSUNG ELECTRONICS CO., LTD., Suwon-si (KR)

(72) Inventors: Jinho Kim, Suwon-si (KR); Tetsuya Shigeta, Suwon-si (KR); Taesoon Park, Suwon-si (KR); Sangmin Shin, Suwon-si (KR); Youngki Jung, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 44 days.

(21) Appl. No.: 16/903,934

(22) Filed: Jun. 17, 2020

(65) Prior Publication Data

US 2020/0394953 A1 Dec. 17, 2020

(30) Foreign Application Priority Data

Jun. 17, 2019 (KR) ..... 10-2019-0071477
Oct. 31, 2019 (KR) ..... 10-2019-0138093
(Continued)

(51) Int. Cl.
*G09G 3/32* (2016.01)
*H05B 45/33* (2020.01)
*H05B 45/325* (2020.01)

(52) U.S. Cl.
CPC ..... *G09G 3/32* (2013.01); *H05B 45/325* (2020.01); *H05B 45/33* (2020.01);
(Continued)

(58) Field of Classification Search
CPC ..... G09G 3/32; G09G 2300/0452; G09G 2310/0275; G09G 2310/0297;
(Continued)

(56) References Cited

U.S. PATENT DOCUMENTS 7,167,169 B2 1/2007 Libsch et al.
7,808,497 B2 10/2010 Lo et al.
(Continued)

FOREIGN PATENT DOCUMENTS

EP 1 755 104 A2 2/2007
EP 3 389 037 A1 10/2018
(Continued)

OTHER PUBLICATIONS

Communication dated Aug. 25, 2020 issued by the European Patent Office in European Application No. 20180373.1.
(Continued)

*Primary Examiner* — Roberto W Flores
(74) *Attorney, Agent, or Firm* — Sughrue Mion, PLLC

(57) ABSTRACT

A display module includes a display panel including an inorganic light emitting element and a pixel circuit configured to provide a driving current to the inorganic light emitting element; and a driver configured to drive the pixel circuit. The pixel circuit includes a pulse amplitude modulation (PAM) circuit configured to control an amplitude of the driving current based on an applied PAM data voltage, and a pulse width modulation (PWM) circuit configured to control a pulse width of the driving current based on an applied PWM data voltage. The driver includes a power supply circuit configured to provide, to the PAM circuit, a first power supply voltage for driving the PAM circuit, and provide, to the PWM circuit, a second power supply voltage for driving the PWM circuit.

10 Claims, 38 Drawing Sheets

(30) Foreign Application Priority Data

Dec. 2, 2019 (KR) ..... 10-2019-0158614
May 6, 2020 (KR) ..... 10-2020-0053707

(52) U.S. Cl.
CPC ..... *G09G 2300/0452* (2013.01); *G09G 2310/0275* (2013.01); *G09G 2310/0297* (2013.01)

(58) Field of Classification Search
CPC .. G09G 3/2011; G09G 3/2014; G09G 3/2081; G09G 2310/0259; G09G 2320/0242; G09G 2320/064; H05B 45/325; H05B 45/33
See application file for complete search history.

(56) References Cited

U.S. PATENT DOCUMENTS

| | | | | |
|---|---|---|---|---|
| 9,357,147 | B2 | 5/2016 | Nishida et al. | |
| 9,478,175 | B2 | 10/2016 | Lim | |
| 10,002,565 | B2 | 6/2018 | Kikuchi et al. | |
| 10,643,537 | B2 | 5/2020 | Kwon et al. | |
| 2001/0019319 | A1* | 9/2001 | Kim | G09G 3/3233 345/77 |
| 2003/0214469 | A1* | 11/2003 | Kageyama | G09G 3/3258 345/82 |
| 2005/0184952 | A1* | 8/2005 | Konno | G09G 3/3648 345/102 |
| 2006/0221003 | A1 | 10/2006 | Ookawara et al. | |
| 2008/0007496 | A1* | 1/2008 | Kim | G09G 3/3266 345/80 |
| 2013/0093737 | A1* | 4/2013 | Ota | G09G 3/3233 345/204 |
| 2014/0160179 | A1 | 6/2014 | Ishii et al. | |
| 2014/0184103 | A1 | 7/2014 | Kim et al. | |
| 2015/0116379 | A1 | 4/2015 | Lim | |
| 2017/0263183 | A1 | 9/2017 | Lin et al. | |
| 2018/0182279 | A1 | 6/2018 | Sakariya et al. | |
| 2018/0293929 | A1 | 10/2018 | Shigeta et al. | |
| 2018/0301080 | A1 | 10/2018 | Shigeta et al. | |
| 2020/0111403 | A1 | 4/2020 | Kim et al. | |
| 2020/0111404 | A1 | 4/2020 | Kim et al. | |
| 2021/0005136 | A1* | 1/2021 | Shin | G09G 3/3291 |

FOREIGN PATENT DOCUMENTS

| | | | |
|---|---|---|---|
| JP | 2015-004945 | A | 1/2015 |
| JP | 6044632 | B2 | 12/2016 |
| KR | 10-0448734 | B1 | 9/2004 |
| KR | 10-2014-0085103 | A | 7/2014 |
| KR | 10-2015-0050791 | A | 5/2015 |
| KR | 10-2018-0078935 | A | 7/2018 |

OTHER PUBLICATIONS

International Search Report (PCT/ISA/210) dated Sep. 17, 2020 issued by the International Searching Authority in International Application No. PCT/KR2020/007796.
Written Opinion (PCT/ISA/237) dated Sep. 17, 2020 issued by the International Searching Authority in International Application No. PCT/KR2020/007796.
Communication dated Oct. 14, 2021 issued by the European Patent Office in European Application No. 20 180 373.1.

* cited by examiner

1300

DISPLAY MODULE AND DRIVING METHOD THEREOF

CROSS-REFERENCE TO RELATED APPLICATION(S)

This application is based on and claims priority under 35 U.S.C. § 119 to Korean Patent Application No. 10-2019-0071477, filed on Jun. 17, 2019, Korean Patent Application No. 10-2019-0138093, filed on Oct. 31, 2019, Korean Patent Application No. 10-2019-0158614, filed on Dec. 2, 2019, and Korean Patent Application No. 10-2020-0053707, filed on May 6, 2020, in the Korean Intellectual Property Office, the disclosures of which are incorporated by reference herein in its entirety.

BACKGROUND

1. Field

The disclosure relates to a display module and a driving method thereof, and more particularly, to a display module in which a pixel includes light emitting elements, and a driving method thereof.

2. Description of the Related Art

In a related art display panel in which inorganic light emitting elements such as a red light emitting diode (LED), a green LED, and a blue LED (hereinafter, the LED refers to inorganic light emitting elements) are driven as sub-pixels, gradations of the sub-pixels are expressed by using a pulse amplitude modulation (PAM) driving method.

In this case, color reproducibility of an image deteriorates, because not only a gradation of emitted light, but also a wavelength of the emitted light changes depending on an amplitude of a driving current. FIG. 1 illustrates a change of a wavelength with respect to on an intensity (or amplitude) of a driving current flowing in a blue LED, a green LED, and a red LED.

A micro LED (μLED) display panel is a flat display panel which includes a plurality of inorganic LEDs each having a size of 100 μm or less. As compared with a liquid crystal display (LCD) panel requiring a backlight, the micro LED display panel may offer better contrast, response times, and energy efficiency. The organic LED (OLED) and the micro LED, which is an inorganic light emitting element, both have excellent energy efficiency, but the micro LED offers higher brightness, better light emitting efficiency, and longer life, in comparison to the OLED.

SUMMARY

In accordance with an aspect of the disclosure, a display module includes a display panel comprising an inorganic light emitting element and a pixel circuit configured to provide a driving current to the inorganic light emitting element; and a driver configured to drive the pixel circuit. The pixel circuit may include a pulse amplitude modulation (PAM) circuit configured to control an amplitude of the driving current based on an applied PAM data voltage, and a pulse width modulation (PWM) circuit configured to control a pulse width of the driving current based on an applied PWM data voltage. The driver may include a power supply circuit configured to provide, to the PAM circuit, a first power supply voltage for driving the PAM circuit, and provide, to the PWM circuit, a second power supply voltage for driving the PWM circuit.

The second power supply voltage may be lower than the first power supply voltage.

The power supply circuit may be provided on a board separate from the display panel.

The power supply circuit may be configured to provide the first power supply voltage to the PAM circuit through a first line, and provide the second power supply voltage to the PWM circuit through a second line.

The display panel may further include a plurality of pixels each comprising a plurality of sub-pixels. The plurality of pixels may be arranged in a matrix form on a glass substrate, each of the plurality of sub-pixels may include an inorganic light emitting element and a pixel circuit, and each inorganic light emitting element may be disposed on and electrically connected to a pixel circuit of a respective sub-pixel.

The driver may further include a gate driver circuit configured to drive the pixels arranged in the matrix form, and a source driver circuit configured to apply the PAM data voltage or the PWM data voltage to each of the pixels or each of the sub-pixels. Each data output of the gate driver circuit may correspond to a row of pixels in the pixel matrix.

The display panel further include a plurality of pixels each including a plurality of sub-pixels. Each of the plurality of pixels may be disposed in each of a plurality of regions formed by intersections between a plurality of data lines to which the PWM data voltage configured to be applied and a plurality of gate lines configured to select a pixel on each data line. The driver may be configured to apply a first control signal to a first gate line of the plurality of gate lines for selecting a plurality of pixels connected to the first gate line and sequentially apply a plurality of second control signals respectively to each the plurality of sub-pixels connected to the first gate line to apply a corresponding PWM data voltage to each of the plurality of sub-pixels connected to the first gate line.

The driver may be configured to apply the first control signal after sequentially applying the plurality of second control signals to the plurality of sub-pixels connected to the first gate line, to apply the corresponding PWM data voltage to each of the plurality of sub-pixels connected to the first gate line.

The driver may be configured to sequentially apply the plurality of second control signals to the plurality of sub-pixels connected to the first gate line while the plurality of pixels connected to the first gate line are selected based on the first control signal to apply the corresponding PWM data voltage to each of the plurality of sub-pixels connected to the first gate line, and collectively apply the plurality of second control signals to the plurality of sub-pixels connected to the first gate line to apply a reset data voltage.

The driver may be configured to sequentially apply the plurality of second control signals to the plurality of sub-pixels connected to the first gate line while the plurality of pixels connected to the first gate line are selected based on the first control signal, to apply the corresponding PWM data voltage and a reset data voltage to each of the plurality of sub-pixels connected to the first gate line.

The plurality of pixels may each include an R sub-pixel, a G sub-pixel, and a B sub-pixel. The plurality of second control signals may include first to third MUX signals for sequentially selecting the R sub-pixel, the G sub-pixel, and the B sub-pixel. The power supply circuit may be configured to provide PWM data voltages corresponding to the R sub-pixel, the G sub-pixel, and the B sub-pixel, respectively sequentially to a data signal line of the R sub-pixel, a data signal line of the G sub-pixel, and a data signal line of the B sub-pixel based on to the first to third MUX signals. A voltage of the data signal line of each of the R sub-pixel, the G sub-pixel, and the B sub-pixel may be in a reset state while the PWM data voltage is applied to data signal lines of other sub-pixels.

In accordance with another aspect of the disclosure, a driving method of a display module including a display panel including an inorganic light emitting element and a pixel circuit configured to provide a driving current to the inorganic light emitting element, and a driver configured to drive the pixel circuit. The driving method may include applying a pulse amplitude modulation (PAM) data voltage and a pulse width modulation (PWM) data voltage to the pixel circuit; and providing, to the inorganic light emitting element, a driving current having an amplitude corresponding to the PAM data voltage and a pulse width corresponding to the PWM data voltage. The pixel circuit may include a PAM circuit for controlling the amplitude of the driving current based on the PAM data voltage, and a PWM circuit for controlling the pulse width of the driving current based on the PWM data voltage. The driver may include a power supply circuit that provides, to the PAM circuit, a first power supply voltage for driving the PAM circuit, and provides, to the PWM circuit, a second power supply voltage for driving the PWM circuit.

The second power supply voltage may be lower than the first power supply voltage. The power supply circuit may provide the first power supply voltage to the PAM circuit through a first line, and provides the second power supply voltage to the PWM circuit through a second line.

BRIEF DESCRIPTION OF THE DRAWINGS

The above and other aspects, features, and advantages of certain embodiments of the present disclosure will be more apparent from the following description taken in conjunction with the accompanying drawings, in which.

DETAILED DESCRIPTION

Figure 1:
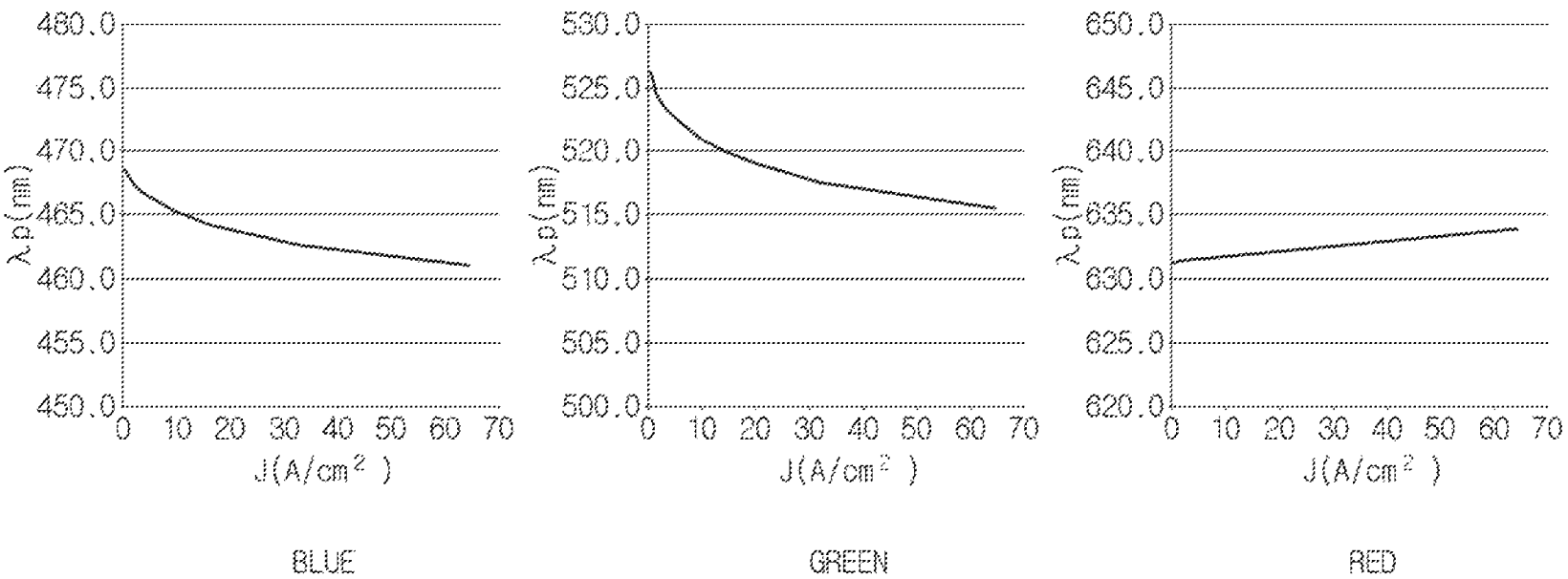
FIG. 1 is a graph illustrating a change of a wavelength based on an intensity of a driving current flowing in a blue LED, a green LED, and a red LED.

The disclosure provides a display module that provides improved color reproducibility of an input image signal through an LED which is an inorganic light emitting element mounted on a glass substrate, and a driving method thereof.

The disclosure provides a display module that includes a pixel circuit capable of more efficiently driving an LED which is an inorganic light emitting element mounted on a glass substrate, and a driving method thereof.

The disclosure provides a display module that includes a driving circuit for driving an LED which is an inorganic light emitting element mounted on a glass substrate, the driving circuit having an optimized design and being suitable for large-scale integration, and a driving method thereof.

The disclosure provides a display module that includes a pixel circuit enabling a stable operation of an LED which is an inorganic light emitting element mounted on a glass substrate, and a driving method thereof.

Detailed description of the known art related to the disclosure that may unnecessarily obscure the gist of the disclosure will be omitted. Further, an overlapping description of the same component will be omitted.

In addition, terms ending in "-er (or -or)" for components used in the following description are used only to easily describe the components. Therefore, these terms do not have meanings or roles that distinguish from each other in themselves.

Terms used in the disclosure are used to describe embodiments, and are not intended to restrict and/or limit the disclosure. Singular forms used herein are intended to include plural forms unless context explicitly indicates otherwise.

It will be understood that terms "include" or "have" used in the specification, specify the presence of features, numerals, steps, operations, components, parts mentioned in the specification, or a combination thereof, but do not preclude the presence or addition of one or more other features, numerals, steps, operations, components, parts, or a combination thereof.

Expressions "first", "second", or the like, used in the disclosure may indicate various components regardless of a sequence and/or importance of the components, will be used only in order to distinguish one component from the other components, and do not limit the corresponding components.

When it is mentioned that any component (for example, a first component) is (operatively or communicatively) coupled with/to or is connected to another component (for example, a second component), it is to be understood that any component is directly coupled to another component or may be coupled to another component through the other component (for example, a third component). On the other hand, when it is mentioned that any component (for example, a first component) is "directly coupled" or "directly connected" to another component (for example, a second component), it is to be understood that a still another component (for example, a third component) is not present between any component and the another component.

Unless otherwise defined, all terms used in describing the embodiments have the same meaning as commonly understood by a person having ordinary skills in the art to which the embodiments pertain.

Hereinafter, various embodiments will be described in detail with reference to the accompanying drawings.

Figure 2A:
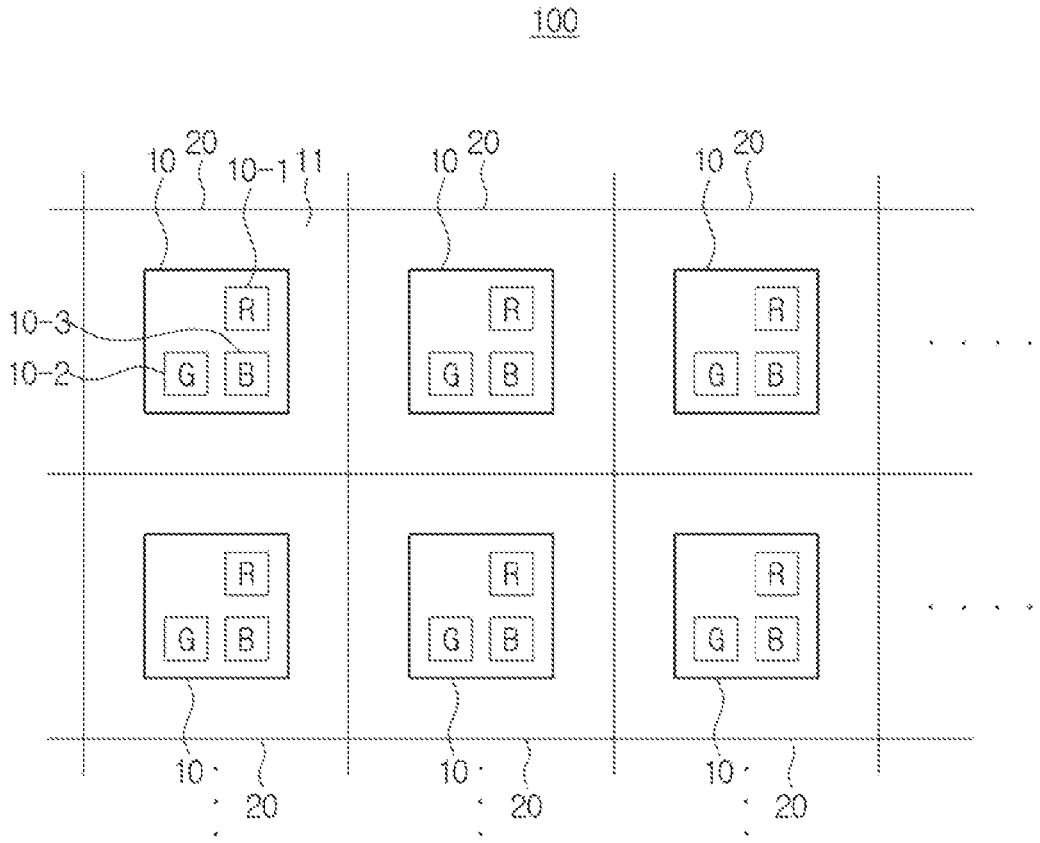
FIG. 2A is a diagram showing a pixel structure of a display panel according to an embodiment.

FIG. 2A is a diagram for describing a pixel structure of a display panel according to an embodiment. As illustrated in FIG. 2A, a display panel 100 may include a plurality of pixels 10 arranged in a matrix form.

Each pixel 10 may include a plurality of sub-pixels 10-1, 10-2, and 10-3. For example, one pixel 10 included in the display panel 100 may include three types of sub-pixels such as a red (R) sub-pixel 10-1, a green (G) sub-pixel 10-2, and a blue (B) sub-pixel 10-3. That is, one set of the R sub-pixel 10-1, the G sub-pixel 10-2, and the B sub-pixel 10-3 may form one unit pixel 10 of the display panel 100.

Referring to FIG. 2A, one pixel region 20 in the display panel 100 may include a region 10 occupied by a pixel, and a remaining region 11 surrounding the region 10 occupied by a pixel.

The R sub-pixel 10-1, the G sub-pixel 10-2, and the B sub-pixel 10-3 may be included in the region 10 occupied by a pixel as shown in FIG. 2A. Specifically, the R sub-pixel 10-1 may include an R inorganic light emitting element and a pixel circuit for driving the R inorganic light emitting element, the G sub-pixel 10-2 may include a G inorganic light emitting element and a pixel circuit for driving the G inorganic light emitting element, and the B sub-pixel 10-3 may include a B inorganic light emitting element and a pixel circuit for driving the B inorganic light emitting element.

Each pixel circuit may include a pulse amplitude modulation (PAM) circuit for performing PAM driving of a connected inorganic light emitting element, and a pulse width modulation (PWM) circuit for performing PWM driving of a connected inorganic light emitting element, but is not limited thereto.

According to some embodiments, various circuits for driving the pixel circuits may be included in the remaining region 11 surrounding the region 10 occupied by a pixel. An example of such an embodiment will be described in more detail with reference to FIG. 6.

Figure 2B:
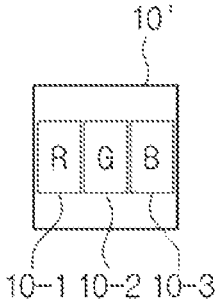
FIG. 2B is a diagram showing a sub-pixel structure in one pixel according to another embodiment.

FIG. 2B is a diagram showing a sub-pixel structure in one pixel according to another embodiment. Referring to FIG. 2A, the sub-pixels 10-1 to 10-3 are arranged in a horizontally reversed L-letter shape in one pixel 10. However, the disclosure is not limited thereto, and an R sub-pixel 10-1, a G sub-pixel 10-2, and a B sub-pixel 10-3 may be arranged in a row in a pixel 10' as shown in FIG. 2B. However, such an arrangement of the sub-pixels is only an example, and a plurality of sub-pixels may be arranged in various forms in each pixel depending on an embodiment.

Although a case where the pixel includes three types of sub-pixels has been described in the above-described example, the disclosure is not limited thereto. For example, the pixel may include four types of sub-pixels such as an R sub-pixel, a G sub-pixel, a B sub-pixel, and a white (W) sub-pixel, and it is a matter of course that one pixel may include a different number of sub-pixels depending on an embodiment. Hereinafter, for convenience of explanation, the case where the pixel 10 includes three types of sub-pixels such as the R sub-pixel, the G sub-pixel, and the B sub-pixel will be described by way of example.

Figure 3:
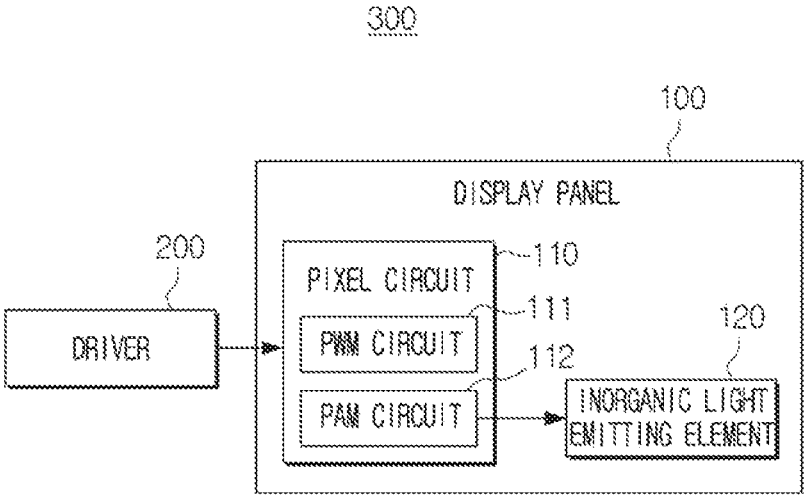
FIG. 3 is a block diagram showing a configuration of a display module according to an embodiment.

FIG. 3 is a block diagram of a display module according to an embodiment.

Referring to FIG. 3, a display device 300 may include a display panel 100 including a pixel circuit 110 and an inorganic light emitting element 120, and a driver 200.

The display panel 100 may have a structure in which the pixel circuit 110 is formed on a substrate 40 and the inorganic light emitting element 120 is disposed on the pixel circuit 110 as will be described later with reference to FIG. 4. FIG. 3 shows only a configuration related to one sub-pixel included in the display panel 100 for convenience of explanation.

The inorganic light emitting element 120 may be mounted on the pixel circuit 110 to be electrically connected to the pixel circuit 110, and emit light based on a driving current provided from the pixel circuit 110.

The inorganic light emitting element 120 may be included in the sub-pixel 10-1, 10-2, or 10-3 of the display panel 100, and there may be a plurality of types of inorganic light emitting elements 120 which emit different colors of light. Examples of the inorganic light emitting element 120 may include a red (R) inorganic light emitting element which emits red light, a green (G) inorganic light emitting element which emits green light, and a blue (B) inorganic light emitting element which emits blue light.

Therefore, the type of the sub-pixel may be determined depending on the type of the inorganic light emitting element 120. That is, the R inorganic light emitting element may be included in the R sub-pixel 10-1, the G inorganic light emitting element may be included in the G sub-pixel 10-2, and the B inorganic light emitting element may be included in the B sub-pixel 10-3.

Here, the inorganic light emitting element 120 refers to a light emitting element manufactured by using an inorganic material that is different from that of an organic light emitting diode (OLED) manufactured by using an organic material.

According to an embodiment of the disclosure, the inorganic light emitting element 120 may be a micro LED (μLED). The micro LED refers to a micro inorganic light emitting element which emits light by itself without a backlight or color filter and has a size of 100 μm or less.

The inorganic light emitting element 120 may emit light at a different brightness depending on an amplitude or pulse width of the driving current provided from the pixel circuit 110. Here, the pulse width of the driving current may also be referred to as a duty ratio of the driving current or a duration of the driving current.

For example, the larger the amplitude of the driving current, the higher the brightness at which the inorganic light emitting element 120 may emit light, and the larger the pulse width (that is, the higher the duty ratio or the longer the duration) the higher the brightness at which the inorganic light emitting element 120 may emit light. However, the disclosure is not limited thereto.

The pixel circuit 110 provides the driving current to the inorganic light emitting element 120. Specifically, the pixel circuit 110 may provide a driving current of which an amplitude and a pulse width are controlled based on a data signal, a power signal, and various control signals applied from the driver 200. That is, the pixel circuit 110 may provide a gradation of light emitted from the inorganic light emitting element 120 by performing PAM driving and/or PWM driving of the inorganic light emitting element 120.

To this end, the pixel circuit 110 may include a PAM circuit 112 for controlling the amplitude of the driving current, and a PWM circuit 111 for controlling the pulse width of the driving current. The PAM circuit 112 may control the amplitude of the driving current based on an applied PAM data voltage, and the PWM circuit 111 may control the pulse width of the driving current based on an applied PWM data voltage.

In particular, the PWM circuit 111 performs the PWM driving of the inorganic light emitting element 120. A PWM driving method is a method of expressing a gradation by controlling a light emission time of the inorganic light emitting element 120, with the pulse width of the driving current. Therefore, in a case of driving the inorganic light emitting element 120 by using the PWM driving method, various gradations of light may be emitted by changing the pulse width of the driving current even in a case that the amplitude of the driving current is uniform. Therefore, it is possible that a wavelength of light emitted from an LED (in particular, a micro LED) changes depending on a gradation which may be caused by driving the LED only using a PAM driving method.

That is, according to an embodiment, the same PAM data voltage may be applied to all PAM circuits 112 in the display panel 100 to make the amplitude of the driving current uniform, thereby resulting in the wavelength change of the LED caused by the change of the amplitude of the driving current not occurring. At the same time, a gradation of an image may be provided by controlling the pulse width of the driving current by applying a PWM data voltage based on a gradation value of each pixel in an image frame to each PWM circuit 111 of the display panel 100.

According to an embodiment of the disclosure, the same PAM data voltage may be applied to all pixels in the display panel 100 as described above, and thus the PAM data voltage may be collectively set (or programmed) for all pixels. Therefore, it is possible to secure a sufficient time for light emission of the LED in a duration of one image frame.

The PWM circuit 111 may include a driving transistor, and may control the pulse width of the driving current by controlling a gate terminal voltage of the driving transistor according to various signals (or voltages) applied.

In a case that a PWM data voltage corresponding to a specific gradation is applied, the PWM circuit 111 may set (or program) the applied PWM data voltage for a gate terminal of the driving transistor.

Then, once a sweep signal is applied, the PWM circuit 111 may change the gate terminal voltage of the driving transistor based on the sweep signal to provide a driving current having a pulse width corresponding to the set PWM data voltage to the inorganic light emitting element 120.

The sweep signal may be a voltage applied from the driver 200 to linearly change the gate terminal voltage of the driving transistor. The sweep signal may be a signal that linearly changes, such as a triangular wave, but is not limited thereto.

The PAM circuit 112 may perform the PAM driving of the inorganic light emitting element 120. The PAM driving method may be a method of expressing a gradation by controlling an intensity of light emitted from the inorganic light emitting element 120, with the amplitude of the driving current.

As described above, according to an embodiment, the same PAM data voltage may be collectively applied to all PAM circuits 112 in the display panel 100. In this case, the amplitude of the driving current provided to the inorganic light emitting element 120 included in each sub-pixel in the display panel 100 is uniform.

However, the disclosure is not limited thereto. For example, for high dynamic range (HDR) driving or the like, a PAM data voltage having a different value may be applied to each PAM circuit 112 in the display panel 100.

As described above, in the display panel 100, the sub-pixel may be configured in a unit of the inorganic light emitting element 120, and the pixel circuit 110 may be present for each inorganic light emitting element 120. Therefore, unlike a liquid crystal display (LCD) panel using, as a backlight, a plurality of inorganic light emitting elements which emit monochromatic light, each pixel circuit 110 of the display panel 100 may drive a corresponding inorganic light emitting element 120 to express a gradation in a unit of sub-pixel.

The driver 200 drives the display panel 100. Specifically, the driver 200 may drive the display panel 100 by providing various control signals, a data signal, and a power signal to the pixel circuit 110.

For example, the driver 200 may include at least one gate driver circuit (or a scan driver circuit) for providing a control signal for driving, in a unit of a transverse line (or in a unit of row), pixels of the display panel 100 that are arranged in a matrix form.

Further, the driver 200 may include a source driver circuit (or a data driver circuit) for providing a data voltage (for example, a PAM data voltage or a PWM data voltage) to the respective pixels (or the respective sub-pixels) of the display panel 100 that are arranged in a matrix form.

Further, the driver 200 may include a MUX circuit for selecting each of the plurality of sub-pixels 10-1 to 10-3 included in the pixel 10.

Further, the driver 200 may include a power supply circuit for providing a power voltage for driving each pixel circuit 110 included in the display panel 100.

According to an embodiment, the power supply circuit may provide, to the PAM circuit 112, a first power voltage for driving the PAM circuit 112, and may provide, to the PWM circuit 111, a second power voltage for driving the PWM circuit 111.

In this case, the first power voltage and the second power voltage may be provided to the PAM circuit 112 and the PWM circuit 111, respectively, through different lines of the power supply circuit. According to an embodiment, the second power voltage may be lower than the first power voltage. A detailed description thereof will be described later.

The driver 200 may include a clock providing circuit for providing a clock signal for driving each pixel included in the display panel 100, and may include a sweep signal providing circuit for providing the above-described sweep signal to the PWM circuit 111.

The driver 200 may be provided as a separate component outside the display panel 100, and may be connected to the display panel 100 through separate wiring. For example, various circuits of the driver 200 described above may be implemented in a chip form, mounted on an external board together with a processor or a timing controller (TCON), and connected to the pixel circuit 110 in the display panel 100 through wiring.

Further, the driver 200 may also be implemented in a thin-film transistor (TFT) layer 30 of the display panel 100, together with the pixel circuit 110 as will be described later with reference to FIG. 6.

However, the disclosure is not limited thereto, and some of various circuits described above that may be included in the driver 200 may be implemented in the display panel 100 and others may be separately provided outside the display panel 100. For example, the sweep signal providing circuit, the power supply circuit, and the data driver circuit may be mounted on an external printed circuit board (PCB) together with a processor or a TCON, and the gate driver circuit and the clock providing circuit may be included in the TFT layer of the display panel 100.

The display module 300 according to various embodiments may be applied, as a single unit, to a wearable device, a portable device, a handheld device, and various electronic products or electric parts requiring a display.

Further, the display module 300 according to various embodiments may also be applied to a display device such as a monitor for a personal computer, a high-resolution television (TV), a digital signage, or an electronic display by assembling a plurality of display modules 300 in a matrix form.

Figure 4:
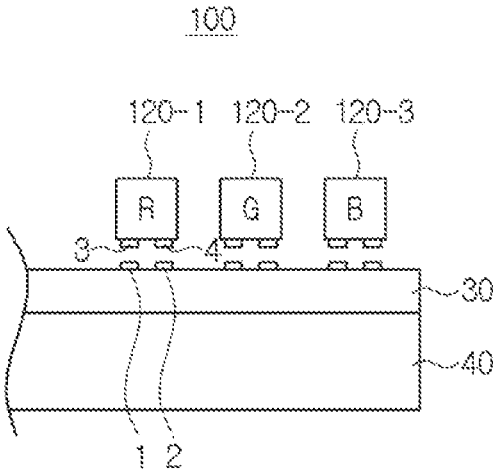
FIG. 4 is a cross-sectional view of the display panel according to an embodiment.

FIG. 4 is a cross-sectional view of the display panel according to an embodiment. For convenience of explanation, FIG. 4 shows only one pixel included in the display panel 100.

Referring to FIG. 4, the display panel 100 includes a glass substrate 40, the TFT layer 30, an R inorganic light emitting element 120-1, a G inorganic light emitting element 120-2, and a B inorganic light emitting element 120-3. The pixel circuits 110 (not shown in FIG. 4) may be implemented by thin-film transistors and included in the TFT layer 30 formed on the glass substrate 40. The R inorganic light emitting element 120-1, the G inorganic light emitting element 120-2, and the B inorganic light emitting element 120-3 may be mounted on the TFT layer 30 and may be included in the sub-pixels 10-1, 10-2, and 10-3 of the display panel 100, respectively.

As such, the display panel 100 in which the TFT layer 30 including the pixel circuits 110 and the inorganic light emitting elements 120-1 to 120-3 are formed on the glass substrate 40 may be referred to as a chip-on-glass (COG) type display panel. The COG type display panel is different from a chip-on-board (COB) type display panel in which a TFT layer and a light emitting element layer are formed on a substrate formed of a synthetic resin or the like.

The TFT layer 30 and the glass substrate 40 may be collectively referred to as a TFT panel. That is, the display panel 100 may be configured by mounting the inorganic light emitting element 120 on the TFT panel. The glass substrate 40 may include various characteristics.

Although not specifically shown in FIG. 4, in the TFT layer 30, the pixel circuit 110 that provides the driving current to each of the inorganic light emitting elements 120-1 to 120-3 is present for each of the inorganic light emitting elements 120-1 to 120-3. Each of the R inorganic light emitting element 120-1, the G inorganic light emitting element 120-2, and the B inorganic light emitting element 120-3 may be mounted or disposed on the TFT layer 30 and electrically connected to each corresponding pixel circuit 110.

For example, as shown in FIG. 4, the R inorganic light emitting element 120-1 may be mounted or disposed in a form in which an anode 3 and a cathode 4 are connected to an anode 1 and a cathode 2 of a corresponding pixel circuit 110 (not shown in FIG. 4), respectively. The same applies to the G inorganic light emitting element 120-2 and the B inorganic light emitting element 120-3. According to an embodiment, any one of the anode 1 or the cathode 2 may be implemented by a common electrode.

FIG. 4 shows an example in which the inorganic light emitting elements 120-1 to 120-3 are flip-chip type micro LEDs. However, the disclosure is not limited thereto, and the inorganic light emitting elements 120-1 to 120-3 may be lateral type micro LEDs or vertical type micro LEDs depending on the embodiment.

Hereinafter, implementation examples of the driver 200 according to various embodiments will be described with reference to FIGS. 5 and 6.

Figure 5:
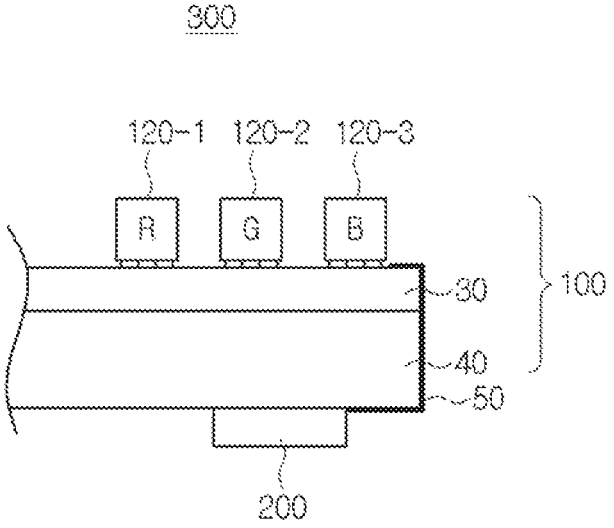
FIG. 5 is a cross-sectional view of a display module according to another embodiment.

FIG. 5 is a cross-sectional view of a display module according to another embodiment. Referring to FIG. 5, a display module 300 may include a TFT layer 30 formed on one surface of a glass substrate 40, inorganic light emitting elements 120-1 to 120-3 each included in a sub-pixel of a display panel 100, a driver 200, and a connection wiring 50 electrically connecting the driver 200 and pixel circuits 110 formed in the TFT layer 30.

As described above, the driver 200 including various circuits may be implemented on a board separate from the display panel 100. FIG. 5 shows an example in which the driver 200 is disposed on a surface of the glass substrate 40, the surface being opposite to a surface on which the TFT layer 30 is formed. The pixel circuits 110 included in the TFT layer 30 may be electrically connected to the driver 200 through the connection wiring 50 formed in an edge region of a TFT panel (or glass substrate).

As such, the pixel circuits 110 and the driver 200 are connected by forming the connection wiring 50 in the edge region of the TFT panel, rather than by forming a hole penetrating through the glass substrate 40. This is because an occurrence of cracking of the glass due to a temperature difference between a process of manufacturing the TFT panel and a process of filling the hole with a conductive material may be caused when connecting the pixel circuits 110 to the driver 200 through the hole penetrating through the glass substrate 40.

Figure 6:
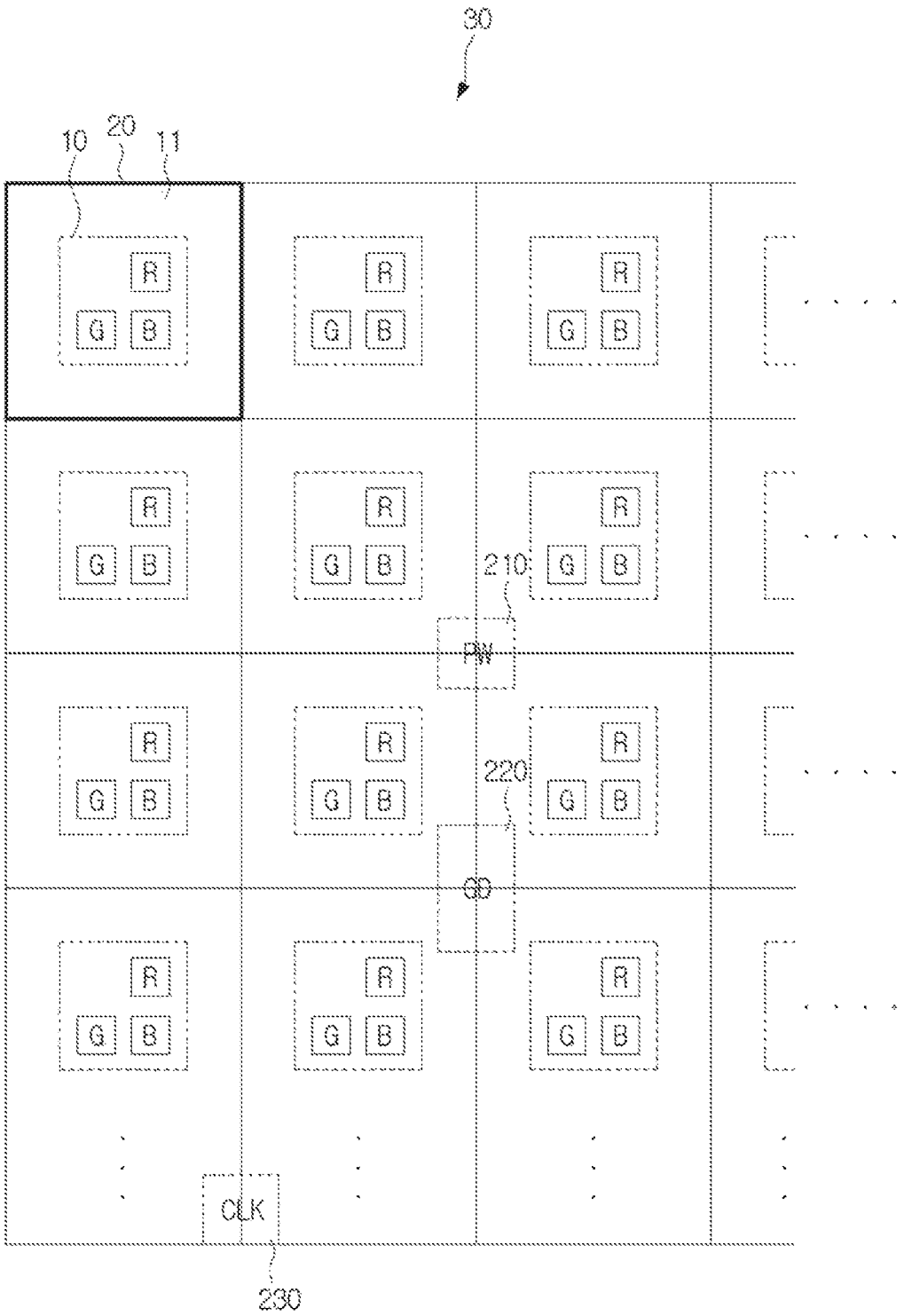
FIG. 6 is a plan view of a thin-film transistor (TFT) layer according to an embodiment.

As described above, the driver 200 may also be implemented in the TFT layer 30 of the display panel 100, together with the pixel circuits 110, as shown in FIG. 6.

FIG. 6 is a plan view of the TFT layer 30 according to an embodiment. Specifically, FIG. 6 shows arrangement of various circuits included in the TFT layer 30 of the display panel 100. Referring to FIG. 6, the entire pixel region 20 occupied by one pixel (or corresponding to one pixel) in the TFT layer 30 includes the region 10 in which the respective pixel circuits 110 for driving the R sub-pixel, the G sub-pixel, and the B sub-pixel are disposed, and the remaining region 11 surrounding region 10.

According to an embodiment, the size of the region 10 occupied by the pixel circuits for the R sub-pixel, the G sub-pixel, and the B sub-pixel may be, for example, ¼ of the size of the entire pixel region 20, but is not limited thereto. As such, in addition to the region 10 occupied by the pixel circuits 110 for driving the respective sub-pixels, the remaining region 11 is present in one pixel region 20, and the same applies to other pixels.

That is, according to an embodiment, the TFT layer 30 may include a larger space in addition to the regions occupied by the pixel circuits 110, and thus at least one of the above-described various circuits (the gate driver circuit, the data driver circuit, the power supply circuit, the clock providing circuit, the sweep signal providing circuit, and the like) that may be included in the driver 200 may be implemented by a TFT and included in the remaining regions 11 of the TFT layer 30.

FIG. 6 shows an example in which a power supply circuit 210, a gate driver circuit 220, and a clock providing circuit 230 are implemented in the TFT layer, together with the pixel circuits 110. In this case, other circuits (for example, the data driver circuit and the sweep signal providing circuit) of the driver 200 for driving the display panel 100 may be disposed in a separate board and connected to the pixel circuits 110 through the connection wiring 50 as described above with reference to FIG. 5. Here, the connection wiring 50 may include a plurality of data lines for applying a data voltage output from the data driver circuit to the pixel circuits 110 of the display panel 100, and at least one sweep signal line for applying a sweep signal output from the sweep signal providing circuit to the pixel circuit 110 of the display panel 100, but the disclosure is not limited thereto.

The positions, sizes and numbers of the power supply circuit 210, the gate driver circuit 220, and the clock providing circuit 230 shown in FIG. 6 are only an example, and are not limited to those shown in FIG. 6.

According to an embodiment, the TFT layer 30 of FIG. 6 may further include a MUX circuit for selecting each of the plurality of sub-pixels 10-1 to 10-3 included in the pixel 10, an electrostatic discharge (ESD) protection circuit for preventing static generated in the display panel 100, and the like.

Figure 7A:
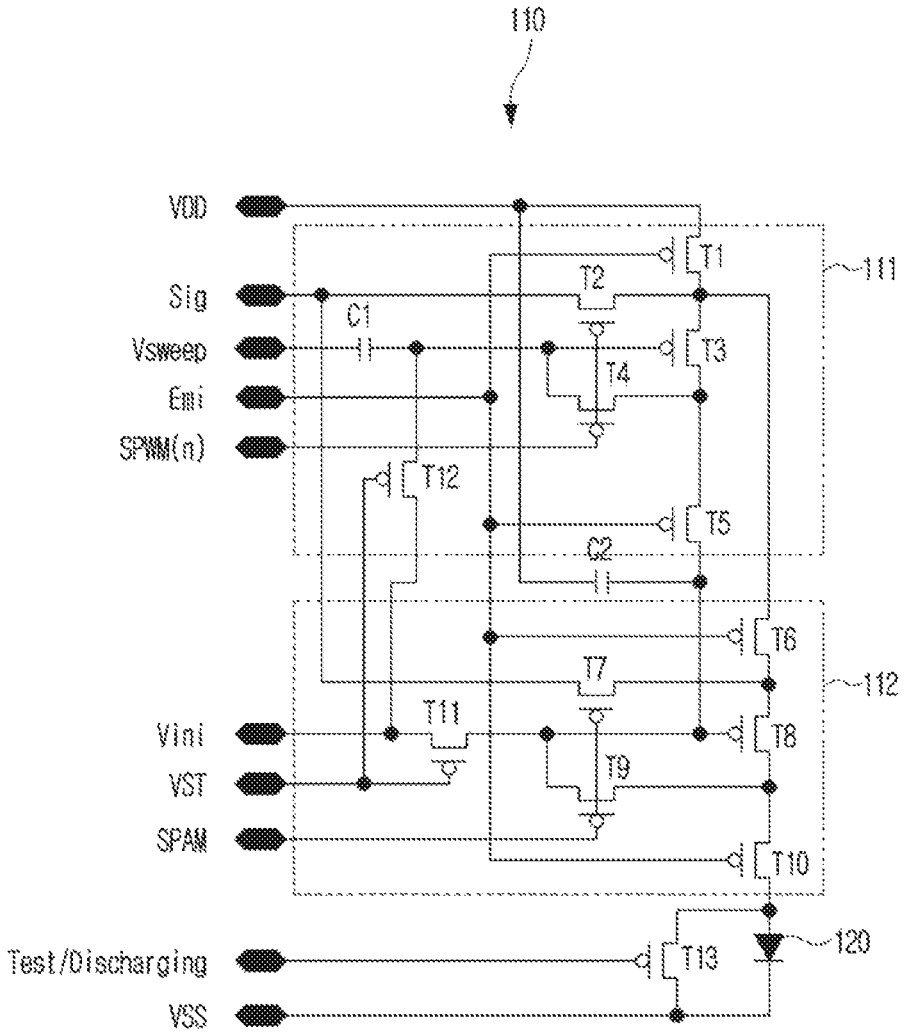
FIG. 7A is a circuit diagram of a pixel circuit according to an embodiment.

FIG. 7A is a detailed circuit diagram of the pixel circuit 110 according to an embodiment. FIG. 7A shows a circuit for one sub-pixel, that is, one inorganic light emitting element 120 and a pixel circuit 110 for driving the one inorganic light emitting element 120. In the display panel 100, the inorganic light emitting element 120 and the pixel circuit 110 as shown in FIG. 7A may be provided for each sub-pixel. The inorganic light emitting element 120 may be an LED with any one color of R, G, or B.

Referring to FIG. 7A, the pixel circuit 110 may include the PAM circuit 112 and the PWM circuit 111.

Once a PAM data voltage is applied through a source terminal of a transistor T7 while transistors T9 and T7 are turned on according to a control signal SPAM, the PAM circuit 112 applies, through turned-on transistors T8 and T9, a voltage with a value obtained by adding up the applied PAM data voltage and a threshold voltage Vth of the transistor T8 to a gate terminal of the transistor T8.

Once a PWM data voltage is applied through a source terminal of a transistor T2 while transistors T4 and T2 are turned on according to a control signal SPWM(n), the PWM circuit 111 applies, through turned-on transistors T3 and T4, a voltage with a value obtained by adding up the applied PWM data voltage and a threshold voltage Vth of the transistor T3 to a gate terminal of the transistor T3.

A transistor T1 may be turned on/off according to a control signal Emi to electrically connect or disconnect a power supply voltage VDD and the PWM circuit 111 to each other.

Transistors T5 and T6 may be turned on/off according to the control signal Emi to electrically connect or disconnect the PWM circuit 111 and the PAM circuit 112 to each other.

A transistor T10 may be turned on/off according to the control signal Emi to electrically connect or disconnect the PAM circuit 112 and the inorganic light emitting element 120 to each other.

A capacitor C1 may be applied with a sweep voltage Vsweep which is a voltage that linearly changes.

Transistors T11 and T12 may be turned on according to a control signal VST and apply an initial voltage Vini to the gate terminal of the transistor T8 and the gate terminal of the transistor T3.

A transistor T13 may be connected between an anode terminal and a cathode terminal of the inorganic light emitting element 120. Before the inorganic light emitting element 120 is mounted on the TFT layer 30 and electrically connected to the pixel circuit 110, the transistor T13 may be turned on according to a control signal Test to check whether or not the pixel circuit 110 is in an abnormal state, and after the inorganic light emitting element 120 is mounted on the TFT layer 30 and electrically connected to the pixel circuit 110, the transistor T13 may be turned on according to a discharging control signal to discharge an electric charge remaining in the inorganic light emitting element 120.

The cathode terminal of the inorganic light emitting element 120 may be connected to a ground voltage (VSS) terminal.

Figure 7B:
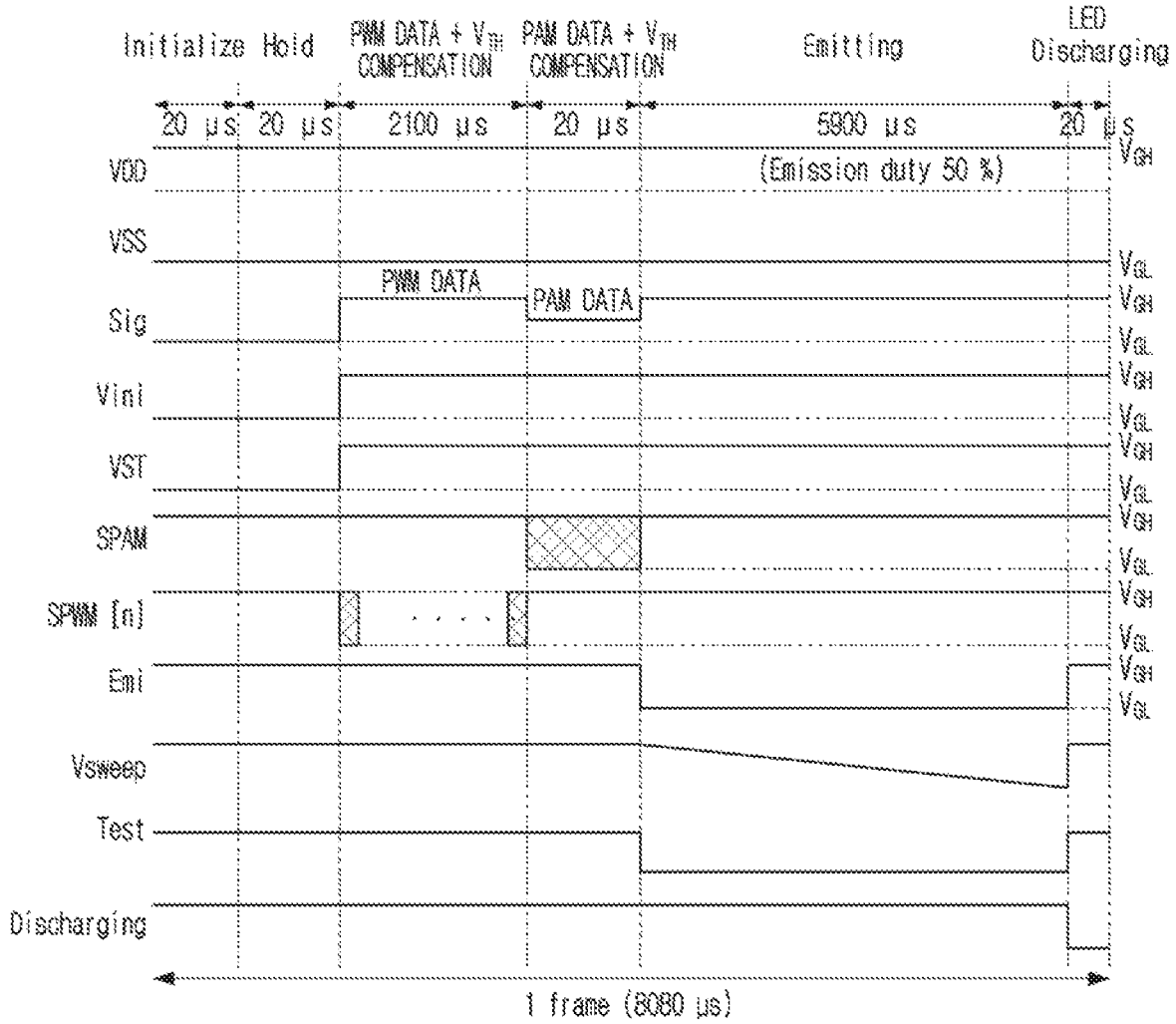
FIG. 7B is a timing diagram of various signals for driving the pixel circuit of FIG. 7A according to an embodiment.

FIG. 7B is a timing diagram of various signals for driving the pixel circuit of FIG. 7A according to an embodiment of the disclosure. Referring to FIG. 7B, the pixel circuit 110 may be driven in an order of an initialization period (Initialize), a holding period (Hold), a data voltage setting and threshold voltage (Vth) compensation period, a light emission period (Emitting), and a discharging period (LED discharging) to display one image frame.

In the example shown in FIG. 7B, the data voltage setting and threshold voltage (Vth) compensation period may include a period (PWM data+Vth compensation) for PWM data voltage setting and threshold voltage compensation of the transistor T3, and a period (PAM data+Vth compensation) for PAM data voltage setting and threshold voltage compensation of the transistor T8.

The initialization period is a period for initializing a gate terminal voltage of each of the transistors T8 and T3. The pixel circuit 110 initializes the gate terminal voltage of each of the transistors T8 and T3 to the initial voltage Vini in the initialization period.

The holding period is a period for continuously holding the gate terminal voltages of the transistors T8 and T3 at a low state (that is, an initialized state). This is because the transistors T8 and T3 need to be in a turned-on state at the time of the start of the data voltage setting and threshold voltage (Vth) compensation period.

The data voltage setting and threshold voltage compensation (Vth) period is a period for setting a data voltage for each of the PAM circuit 112 and the PWM circuit 111, and for compensating the threshold voltage Vth of each of the transistors T8 and T3.

According to an embodiment, as shown in FIG. 7B, the PWM data voltage setting and threshold voltage compensation of the transistor T3 may be performed first, and the PAM data voltage setting and threshold voltage compensation of the transistor T8 may be performed later, and vice versa depending on an embodiment.

In the data voltage setting and threshold voltage compensation period, all the transistors T1, T5, T6, and T10 may be turned off according to the control signal Emi, and therefore, the data voltage setting and the threshold voltage compensation may be performed in a state in which the PAM circuit 112 and the PWM circuit 111 become isolated from each other.

Figure 7C:
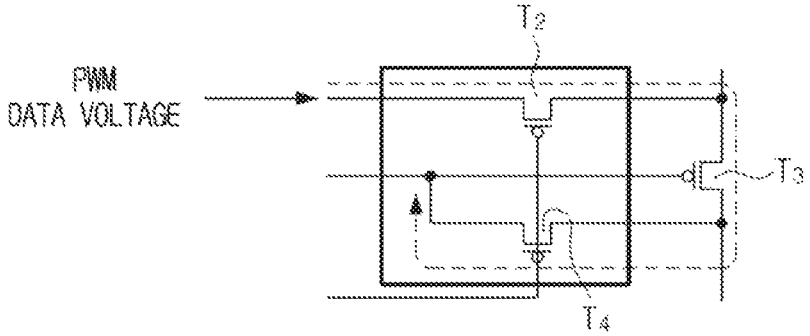
FIG. 7C is a diagram showing data voltage setting and threshold voltage compensation of a pulse width modulation (PWM) circuit according to an embodiment.

FIG. 7C is a diagram showing voltage setting and threshold voltage compensation of the PWM circuit 111.

As described above, a plurality of sub-pixels are present in the display panel 100, and a transistor T3 of a corresponding PWM circuit 111 is present in each sub-pixel. Theoretically, transistors produced under the same condition should have the same threshold voltage. However, in practice, even in a case that transistors are produced under the same condition, threshold voltages Vth thereof may be different, and the same applies to the transistors T3 included in the display panel 100.

As such, in a case that there is a difference between the threshold voltages of the transistors T3 corresponding to the sub-pixels of the display panel 100, driving currents of which pulse widths are different as much as a difference between the threshold voltages are provided to the respective light emitting elements 120, even in a case that the same PWM data voltage is applied to the gate terminals of the transistors T3. In this case, the image may have a smudge or the like, which is problematic.

Therefore, the threshold voltage Vth of the transistor T3 included in the PWM circuit 111 may need to be compensated.

Specifically, referring to FIG. 7C, once the PWM data voltage is applied, the PWM circuit 111 applies, to the gate terminal of the transistor T3, a voltage corresponding to a sum of the applied PWM data voltage and the threshold voltage Vth of the transistor T3, thereby compensating for the threshold voltage of the transistor T3.

To this end, as shown in FIG. 7C, the PWM circuit 111 includes the transistor T4 connected between the gate terminal and a drain terminal of the transistor T3, and the transistor T2 having a drain terminal and a gate terminal that are connected to a source terminal of the transistor T3 and a gate terminal of the transistor T4, respectively.

Once the transistors T2 and T4 are turned on according to the control signal SPWM(n) applied to the gate terminals of the transistors T2 and T4, the PWM data voltage applied to the source terminal of the transistor T2 is input to the PWM circuit 111.

Here, the transistor T3 is fully turned on, because the initial voltage Vini in the low state is applied to the gate terminal of the transistor T3.

Therefore, the input PWM data voltage sequentially passes through the transistor T2, the transistor T3, and the transistor T4, and is applied to the gate terminal of the transistor T3.

Here, the gate terminal voltage of the transistor T3 is increased not to the input PWM data voltage, but to the voltage corresponding to the sum of the PWM data voltage and the threshold voltage Vth of the transistor T3.

In the embodiment shown in FIG. 7C, when the PWM data voltage is initially applied to the PWM circuit 111, the gate terminal voltage of the transistor T3 is in a low state, and thus the transistor T3 is fully turned on and a sufficient current flows, which results in a smooth increase of the gate terminal voltage of the transistor T3. However, as the gate terminal voltage of the transistor T3 is increased, a voltage difference between the gate terminal and the source terminal of the transistor T3 is decreased, which results in a decrease of the current flow. Once the voltage difference between the gate terminal and the source terminal of the transistor T3 reaches the threshold voltage of the transistor T3, the transistor T3 is finally turned off, and the current flow thus stops.

That is, the gate terminal voltage of the transistor T3 is increased only to the voltage corresponding to the sum of the PWM data voltage and the threshold voltage of the transistor T3, because the PWM data voltage is applied to the source terminal of the transistor T3.

As such, the threshold voltage Vth of the transistor T3 included in the PWM circuit 111 may be compensated during the setting of the PWM data voltage.

Referring to FIG. 7A, the PAM circuit 112 includes the transistor T9 connected between the gate terminal and a drain terminal of the transistor T8, and the transistor T7 having a drain terminal and a gate terminal that are connected to a source terminal of the transistor T8 and a gate terminal of the transistor T9, respectively.

Therefore, the threshold voltage compensation operation of the PWM circuit 111 described above may be applied similarly even in a case of compensating for the threshold voltage Vth of the transistor T8 included in the PAM circuit 112.

That is, once the PAM data voltage is applied, the PAM circuit 112 also applies, to the gate terminal of the transistor T8, a voltage corresponding to a sum of the applied PAM data voltage and the threshold voltage Vth of the transistor T8, thereby compensating for the threshold voltage of the transistor T8. Hereinafter, an overlapping description will be omitted.

As described above, according to an embodiment, the PWM circuit 111 automatically performs internal compensation for the threshold voltage of the transistor T3 while the applied PWM data voltage is set for (or applied to) the gate terminal of the transistor T3, and the same applies to the PAM circuit 112.

Here, "internal compensation" means that the threshold voltages of the transistors T3 and T8 are independently compensated in the circuits 111 and 112, respectively, during the operations of the PWM circuit 111 and the PAM circuit 112.

Such an internal compensation method is different from an external compensation method of compensating for the threshold voltage of the transistor T3 or T8 by correcting the PWM data voltage or the PAM data voltage at the outside of the pixel circuit 110. Referring back to FIG. 7B, the control signals SPWM(n) and SPAM may be signals output from at least one gate driver circuit inside or outside the display panel 100. In SPWM(n), n means a number of a pixel line included in the display panel 100.

According to an embodiment, unlike the control signal SPWM(n), the control signal SPAM may be collectively applied to all pixels (or all sub-pixels) included in the display panel 100. That is, the PAM data voltage may be collectively applied to all pixels (or all sub-pixels) included in the display panel 100. Here, according to an embodiment, the PAM data voltage collectively applied to all sub-pixels included in the display panel 100 may have the same value, but the disclosure is not limited thereto.

The above-described embodiments may be implemented because the display panel 100 may include the PWM circuit 111 to provide a gradation of the image by using the PWM method, and the threshold voltage of the transistor T8 of the PAM circuit 112 which may be included in the display panel 100 is internally compensated. Accordingly, it is possible to secure a sufficient light emission period in which the light emitting element 120 emits light, in an entire time period for displaying one image frame.

The light emission period (Emitting) is a period in which the inorganic light emitting element 120 emits light. In the light emission period, the inorganic light emitting element 120 emits light according to the amplitude and the pulse width of the driving current provided from the pixel circuit 110, thereby expressing a gradation corresponding to the applied PAM data voltage and PWM data voltage.

Specifically, in the light emission period, the transistors T1, T5, T6, and T10 may be turned on according to the control signal Emi, and therefore, the PAM circuit 112 and the PWM circuit 111 may be electrically connected to each other, and the power supply voltage VDD may be applied to the inorganic light emitting element 120.

Once the light emission period starts, the power supply voltage VDD is transferred to the inorganic light emitting element 120 through the transistor T1, the transistor T6, the transistor T8, and the transistor T10. Therefore, a potential difference is applied across the inorganic light emitting element 120, and the inorganic light emitting element 120 starts to emit light. Here, the driving current enabling the light emission of the inorganic light emitting element 120 has an amplitude corresponding to the PAM data voltage.

In the light emission period, the sweep voltage Vsweep which is a voltage that linearly changes is applied to the capacitor C1. For example, in a case that the sweep voltage Vsweep is a voltage that is gradually decreased from +4V to 0V, a coupling voltage is applied to the gate terminal of the transistor T3 in a floating state through the capacitor C1.

Therefore, the gate terminal voltage of the transistor T3 is decreased according to the sweep voltage, and once the decreased voltage reaches the threshold voltage of the transistor T3, the transistor T3 switches from the turned-off state to the turned-on state.

Once the transistor T3 is turned on, the power supply voltage VDD is transferred to the gate terminal of the transistor T8 through the transistor T1, the transistor T3, and the transistor T5. Once the power supply voltage VDD is applied to the gate terminal of the transistor T8, the transistor T8 is turned off. Once the transistor T8 is turned off, the power supply voltage VDD may not reach the inorganic light emitting element 120, and thus the light emission of the inorganic light emitting element 120 ends.

As such, the PWM circuit 111 provides the driving current to the inorganic light emitting element 120 from when the power supply voltage VDD is applied to the inorganic light emitting element 120 to when the voltage applied to the gate terminal of the transistor T3 changes according to the sweep voltage Vsweep and reaches the threshold voltage of the transistor T3. That is, the driving current has a pulse width corresponding to the PWM data voltage.

There may be an electric change remaining in the inorganic light emitting element 120 even after the end of the light emission of the inorganic light emitting element 120. Therefore, the inorganic light emitting element 120 may emit dim light after the end of the light emission, which may occur when expressing a low gradation (for example, black).

The discharging period (LED Discharging) is a period for discharging the electric charge remaining in the inorganic light emitting element 120 after the end of the light emission period. The pixel circuit 110 turns on the transistor T13 according to the discharging control signal to completely discharge the electric charge remaining in the inorganic light emitting element 120 to the ground voltage (VSS) terminal, and as a result, low gradation may be provided.

Before the inorganic light emitting element 120 is mounted on the TFT layer 30 and electrically connected to the pixel circuit 110, the transistor T13 may be used to check whether or not the pixel circuit 110 is in an abnormal state. For example, a developer or a manufacturer of the product may turn on the transistor T13 during the light emission period, and check a current flowing in the transistor T13 to check whether or not the pixel circuit 110 is in an abnormal state (for example, the circuit is shorted or open).

Various data signals (Sig), power supply signals (VDD and VSS), and control signals (Vsweep, Emit, SPWM(n), SPAM, Vini, VST, and Text/Discharging) shown in FIG. 7B may be received from an external TCON, processor, power supply circuit, or driver circuit (for example, a data driver or gate driver).

Figure 8:
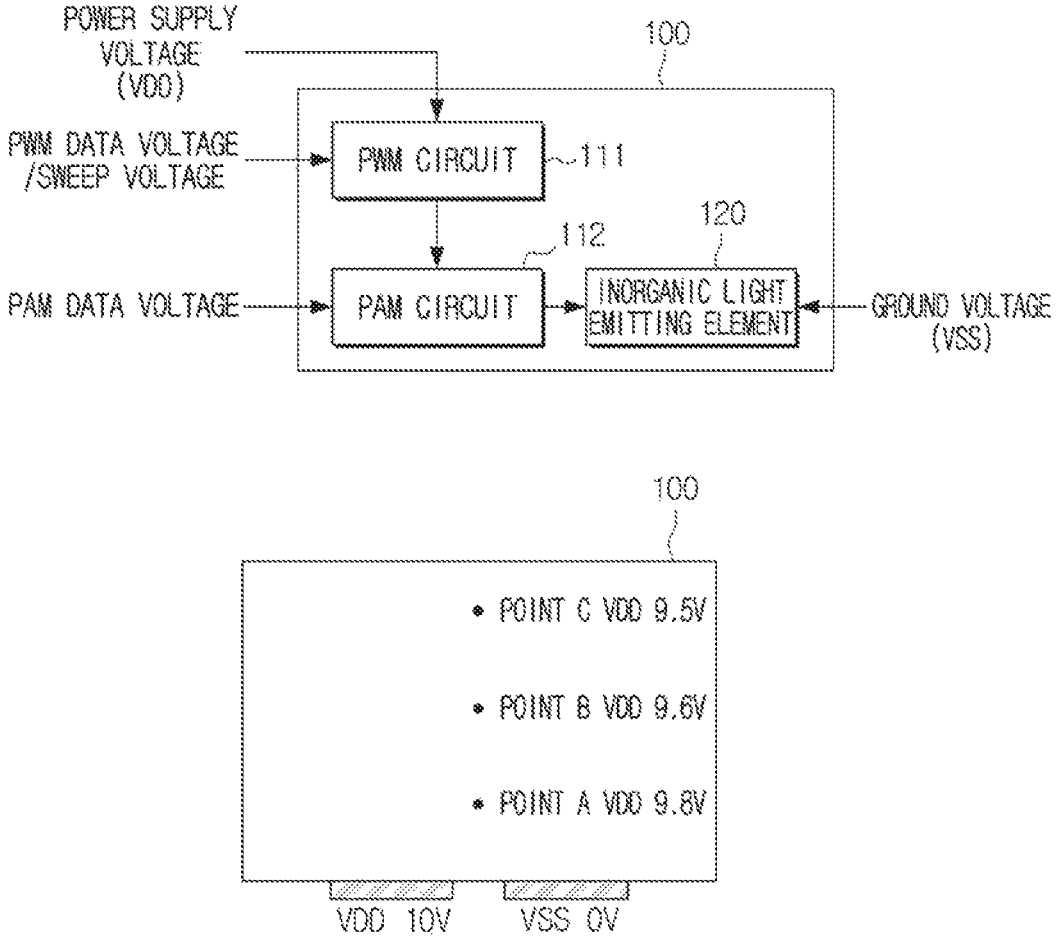
FIG. 8 is a diagram showing an operation of the display panel according to an embodiment.

FIG. 8 is a diagram presenting a problem that may occur at the time of operation of the display panel according to an embodiment. According to an embodiment, the pixel circuit 110 (the PWM circuit 111 and the PAM circuit 112) may be driven by one power supply voltage VDD as shown in FIG. 8. Also in the pixel circuit 110 of the embodiment shown in FIG. 7A, the PWM circuit 111 and the PAM circuit 112 may be driven by one power supply voltage VDD.

In this case, however, the use of the same power supply voltage VDD by the PAM circuit 112 that uses the power supply voltage VDD to apply the driving current to the inorganic light emitting element 120, and the PWM circuit 111 that controls only the pulse width of the driving current by turning on/off the transistor (for example, T3 in FIG. 7A) may be undesirable in certain situations.

Specifically, in a case that the PWM circuit 111 and the PAM circuit 112 use the same power supply voltage VDD, the power supply voltage may vary depending on a position in the display panel 100 due to a difference in resistance between regions of the display panel 100 (specifically, the TFT panel or glass substrate). For example, as shown in the lower drawing of FIG. 8, assuming that the power supply circuit applies the power supply voltage VDD of 10 V to the display panel 100, even though the same driving current flows in the inorganic light emitting elements 120 of the display panel 100, the power supply voltage varies depending on the region of the display panel 100 (9.8V at a position A, 9.6V at a position B, and 9.5V at a position C) due to IR-drop.

As shown in the circuit structure of FIG. 7A, an operation timing of the PWM circuit 111 may be affected not only by the PWM data voltage, but also by the power supply voltage VDD. Therefore, in a case where the power supply voltage VDD applied to the pixel circuit 110 varies depending on the region of the display panel 100 as described above, the operation timing of the PWM circuit 111 may also vary for the same PWM data voltage. As a result, different gradations may be expressed for the same PWM data voltage, which may cause a smudge or the like to appear at the time of expressing a low gradation such as black.

Figure 9:
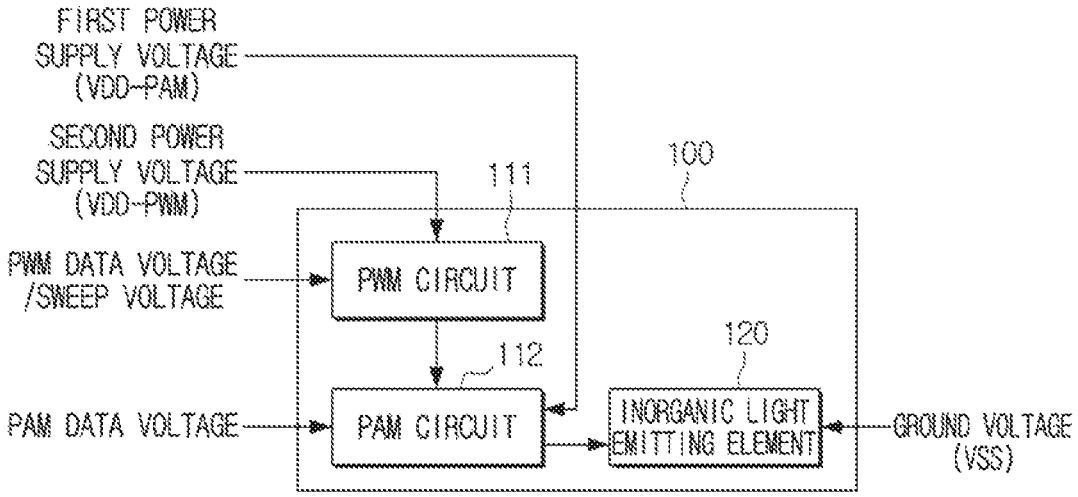
FIG. 9 is a block diagram of a display panel according to another embodiment.

A smudge or the like appearing at the time of expressing a low gradation such as black may be prevented by applying separate power supply voltages to the PWM circuit 111 and the PAM circuit 112, respectively. FIG. 9 is a block diagram of a display panel 100 according to an embodiment. As shown in FIG. 9, a first power supply voltage VDD_PAM may be applied to the PAM circuit 112, and a second power supply voltage VDD_PWM may be applied to the PWM circuit 111.

That is, the power supply voltage of the PAM circuit 112 used to provide the driving current to the inorganic light emitting element 120 and the power supply voltage of the PWM circuit 111 used to control a pulse width of a driving current by turning on/off a transistor may be separate from each other, thereby preventing different gradations from being expressed for the same PWM data voltage.

Specifically, the PWM circuit 111 uses the separate power supply voltage VDD_PWM, and thus the PWM circuit 111 is not affected even in a case that the power supply voltage VDD_PAM of the PAM circuit 112 varies depending on the region of the display panel 100 due to the difference in resistance between the regions of the display panel 100 as described above. Therefore, consistent gradations may be expressed for the same PWM data voltage.

In a case that the power supply voltages applied to the PWM circuit 111 and the PAM circuit 112 are separate from each other as described above, it is also possible to widen a dynamic range of the sweep voltage by decreasing the power supply voltage VDD_PWM applied to the PWM circuit 111.

Specifically, there may be a limitation in decreasing the power supply voltage VDD_PAM, because it is necessary to stably provide the driving current. However, the PWM circuit 111 may only require a voltage that is enough to turn on/off the transistor (for example, T3 in FIG. 7A), and thus the power supply voltage VDD_PWM that is lower than the power supply voltage VDD_PAM of the PAM circuit 112 may be used.

As the power supply voltage VDD_PWM of the PWM circuit 111 is decreased, the dynamic range of the sweep voltage may be widened, and as the dynamic range of the sweep voltage is widened, a gradation may be expressed with a voltage in a wider range. As a result, stable expression of a gradation may be enabled.

Figure 10A:
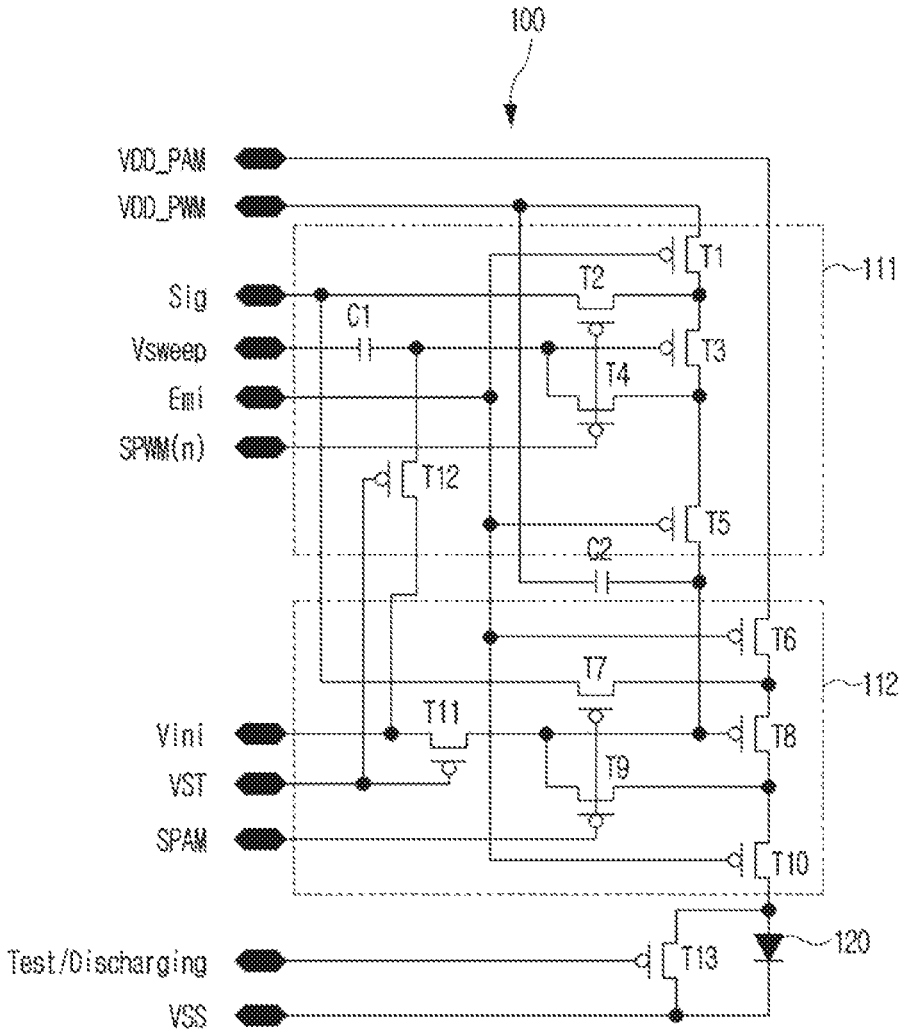
FIG. 10A is a circuit diagram of a pixel circuit according to another embodiment.
Figure 10B:
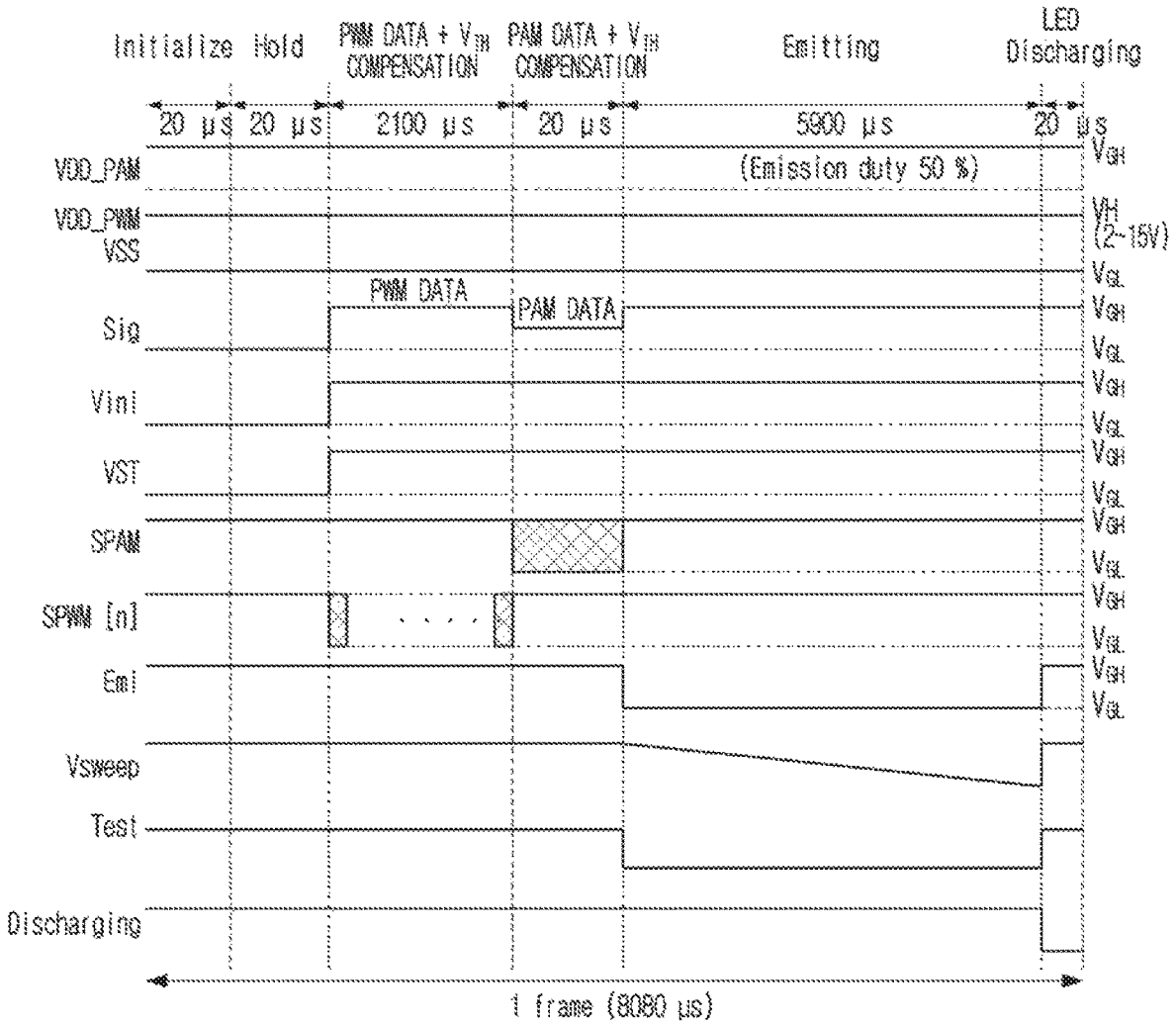
FIG. 10B is a timing diagram of various signals for driving the pixel circuit of FIG. 10A according to an embodiment.

FIG. 10A is a circuit diagram of a pixel circuit according to another embodiment, and FIG. 10B is a timing diagram of various signals for driving the pixel circuit of FIG. 10A according to an embodiment.

FIGS. 10A and 10B correspond to FIGS. 7A and 7B, respectively. However, unlike FIGS. 7A and 7B, FIGS. 10A and 10B show the case that a power supply voltage VDD_PAM is applied to a PAM circuit 112, and a power supply voltage VDD_PWM is applied to a PWM circuit 111. Further, FIG. 10B shows an example in which in a case that the power supply voltage VDD_PAM of the PAM circuit 112 is 15V, the power supply voltage VDD_PWM of the PWM circuit 111 is equal to or lower than 15V (for example, 2V to 15V). Configurations and operations of other circuits are the same as those described with reference to FIGS. 7A and 7B, and thus an overlapping description will be omitted.

Figure 11A:
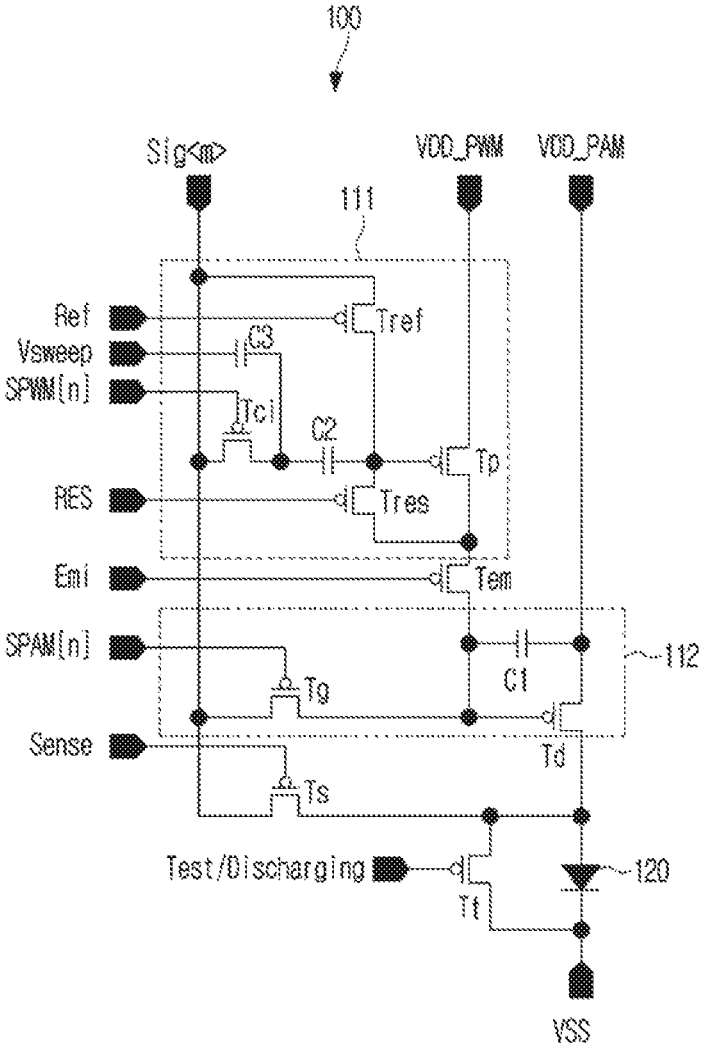
FIG. 11A is a circuit diagram of a pixel circuit according to still another embodiment.
Figure 12A:
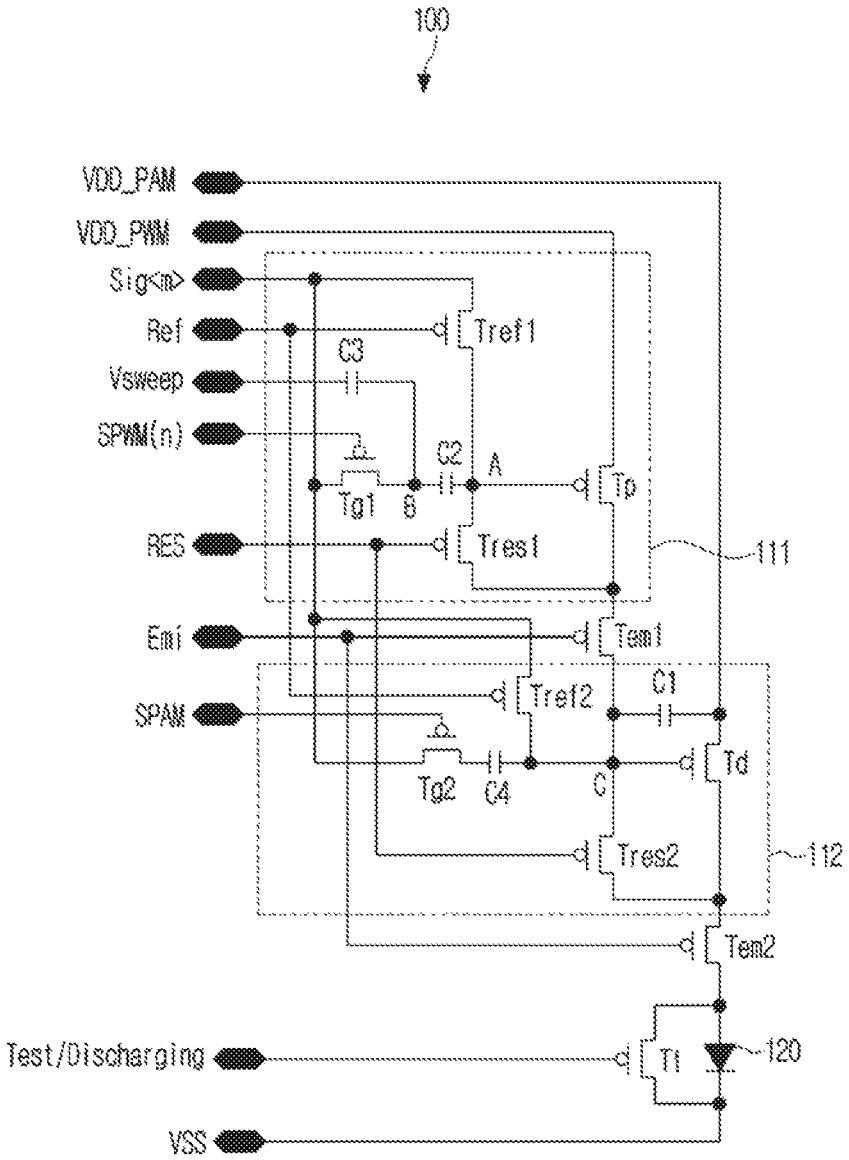
FIG. 12A is a circuit diagram of a pixel circuit according to further still another embodiment.

The concept that power supply voltages are separately applied to the PAM circuit 112 and the PWM circuit 111 may be applied to various pixel circuits each including the PAM circuit 112 and the PWM circuit 111. FIGS. 11A and 12A show pixel circuits 110 according to various embodiments.

Figure 11B:
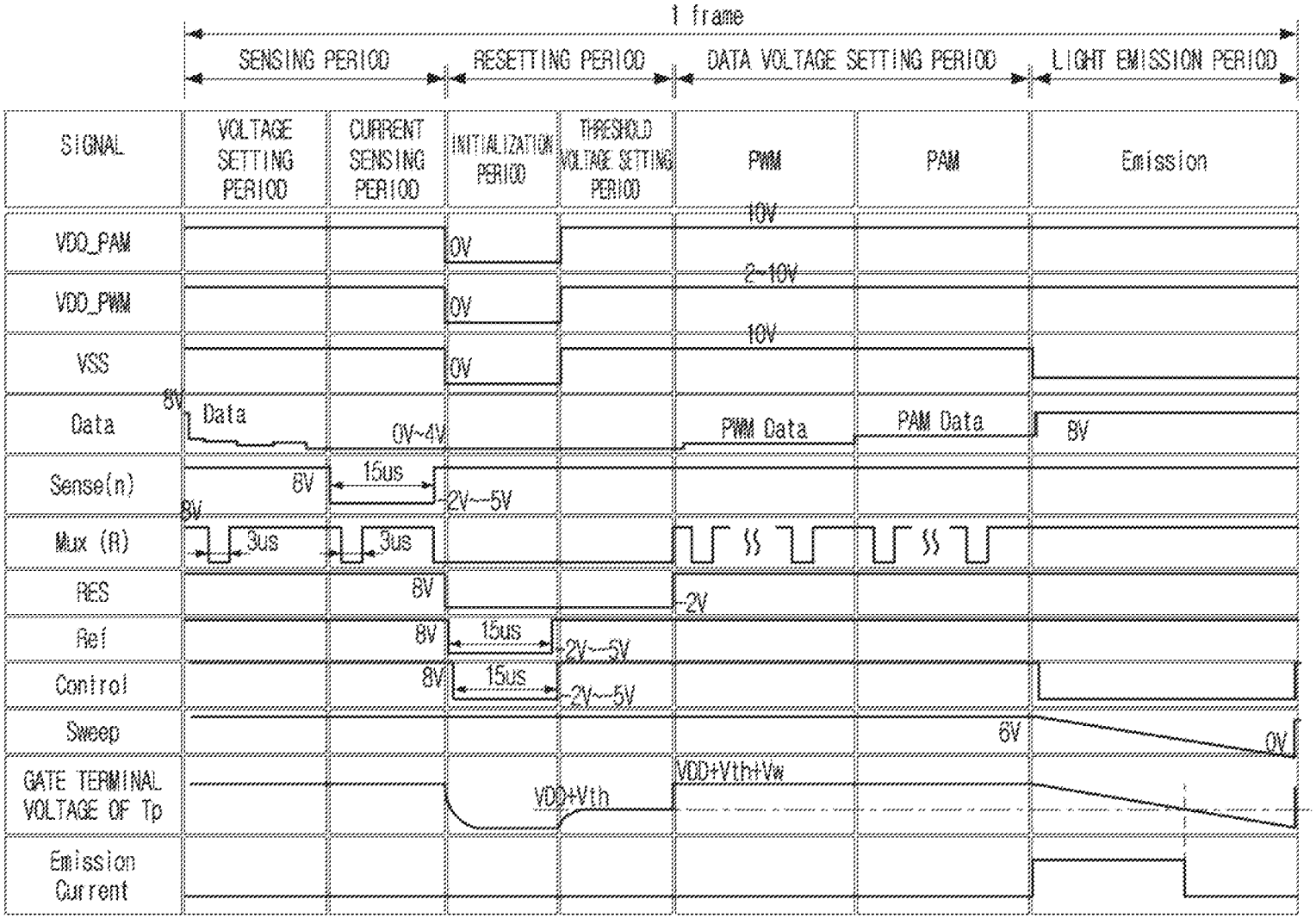
FIG. 11B is a timing diagram of various signals for driving the pixel circuit of FIG. 11A according to an embodiment.
Figure 11C:
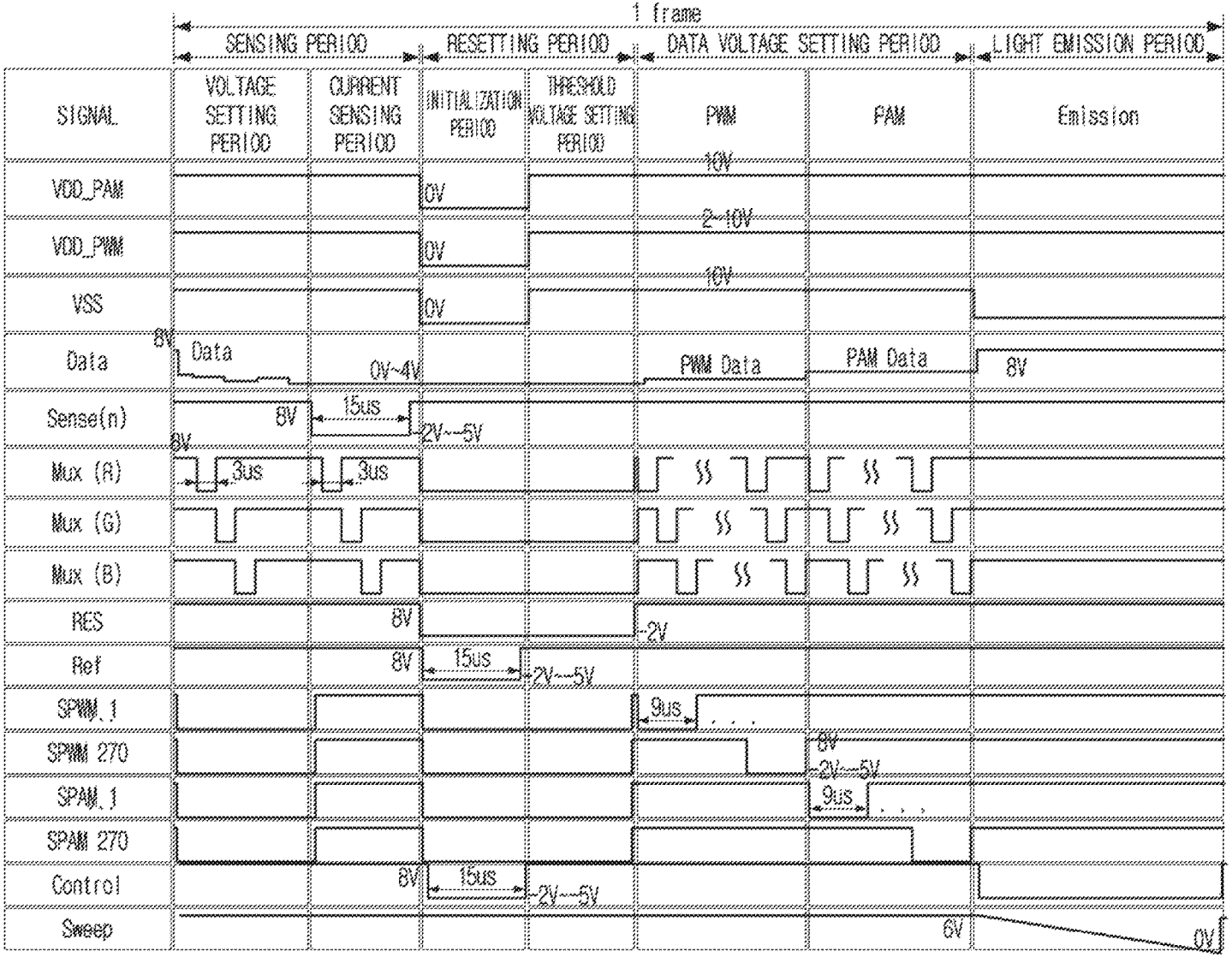
FIG. 11C is a timing diagram of various signals for driving an entire display panel including pixel circuits as illustrated in FIG. 11A according to an embodiment.

The pixel circuit 110 of FIG. 11A may be driven according to various signals as shown in FIG. 11B. FIG. 11C is a timing diagram of various signals for driving an entire display panel 100 with 270 transverse lines according to an embodiment of the disclosure. The display panel 100 including pixel circuits 110 as shown in FIG. 11A may be driven according to various signals as shown in FIG. 11C.

Figure 12B:
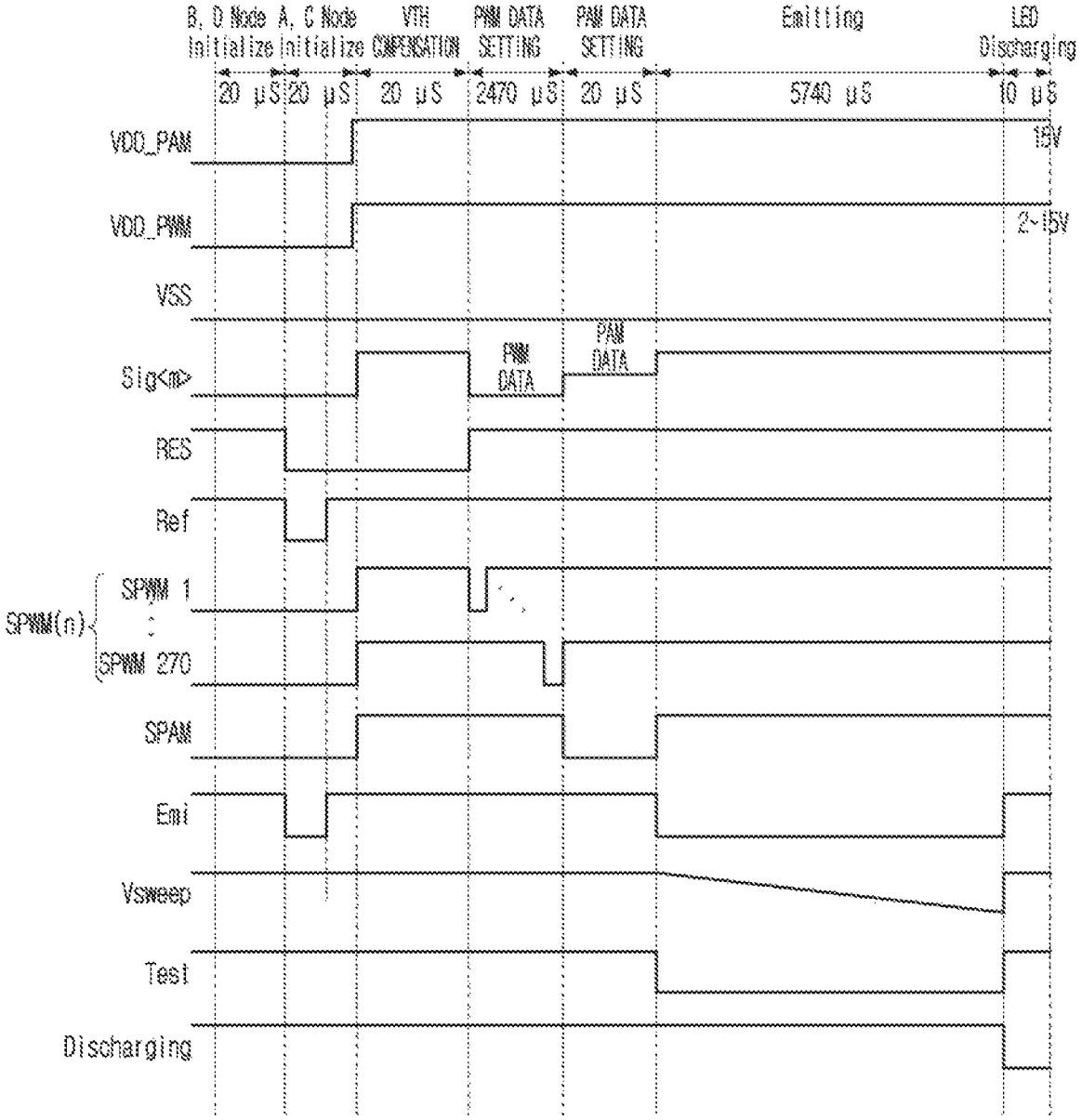
FIG. 12B is a timing diagram of various signals for driving the pixel circuit of FIG. 12A according to an embodiment.

The pixel circuit 110 of FIG. 12A may be driven according to various signals as shown in FIG. 12B.

As may be appreciated from FIGS. 11A to 12B, according to various embodiments of the disclosure, a first power supply voltage VDD_PAM may be applied to the PAM circuit 112, and a second power supply voltage VDD_PWM may be applied to the PWM circuit 111. Further, a dynamic range of a sweep voltage Vsweep may be widened by using the second power supply voltage VDD_PWM that is lower than the first power supply voltage VDD_PAM.

Figure 13:
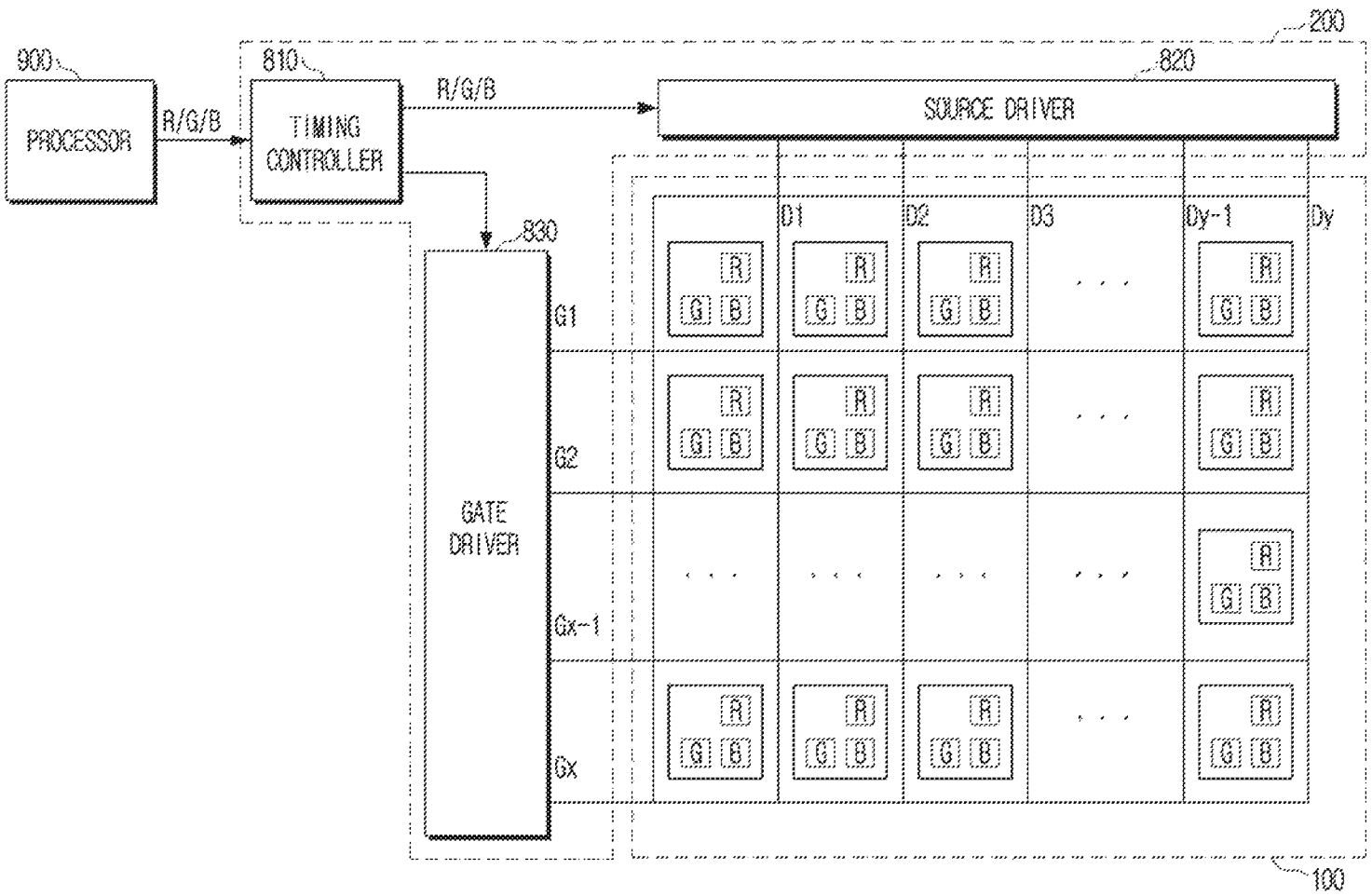
FIG. 13 is a diagram showing a configuration of a display apparatus according to an embodiment.

FIG. 13 is a diagram showing a configuration of a display apparatus according to an embodiment. Referring to FIG. 13, a display apparatus 1300 includes a display panel 100, a driver 200, and a processor 900.

The display panel 100 includes a plurality of pixels, and each pixel includes a plurality of sub-pixels.

Specifically, in the display panel 100, gate lines (or scan lines) G1 to Gx and data lines D1 to Dy may be formed to intersect with each other, and each pixel may be formed in a region formed by the intersection.

Here, each pixel may include three sub-pixels such as an R sub-pixel, a G sub-pixel, and a B sub-pixel, and each sub-pixel included in the display panel 100 may include an inorganic light emitting element 120 with a corresponding color, and a pixel circuit 110 providing, to the inorganic light emitting element 120, a driving current of which an amplitude and a pulse width are controlled according to data voltage.

Here, the data lines D1 to Dy are lines for applying a data voltage (PAM data voltage, PWM data voltage, or the like) to the pixel circuit 110 of each sub-pixel included in the display panel 100, and the gate lines G1 to Gx are lines for selecting the pixel circuits 110 of the sub-pixels included in the display panel for each line. Therefore, data voltages applied through the data lines D1 to Dy may be applied to pixel circuits 110 connected to a selected gate line according to a control signal (for example, SPWM(n) or SPAM).

Here, according to an embodiment, a data voltage to be applied to a pixel connected to each data line may be applied to each of the data lines D1 to Dy. Here, one pixel includes a plurality of sub-pixels (for example, an R sub-pixel, a G sub-pixel, and a B sub-pixel), and thus data voltages (that is, an R data voltage, a G data voltage, and a B data voltage) to be applied to the R sub-pixel, the G sub-pixel, and the B sub-pixel included in one pixel, respectively, may be time-shared and applied to the respective sub-pixels through one data line.

However, the disclosure is not limited thereto. That is, according to an embodiment, a separate data line may be provided for each of the R sub-pixel, the G sub-pixel, and the B sub-pixel, unlike the embodiment shown in in FIG. 13. Here, the data voltages (that is, the R data voltage, the G data voltage, and the B data voltage) to be applied to the R sub-pixel, the G sub-pixel, and the B sub-pixel included in one pixel, respectively, need not be time-shared and applied to the respective sub-pixels, and corresponding data voltages may be applied to corresponding sub-pixels, respectively, through each data line at the same time. Accordingly, in this case, the MUX circuit is not required as well. However, data lines of which the number is three times as many as those in the above-described example are required.

FIG. 13 shows one set of gate lines such as G1 to Gx for convenience of illustration. However, the actual number of gate lines may vary depending on the type of the pixel circuit 110 included in the display panel 100 and a driving method.

In particular, the pixel circuits 110 according to various embodiments of the disclosure may each include the PWM circuit 111 and the PAM circuit 112. Therefore, in the display panel 100, gate lines G1 to Gx for selecting the PWM circuits 111 for each line, and gate lines G1 to Gx for selecting the PAM circuits 112 for each line may be provided.

Figure 19A:
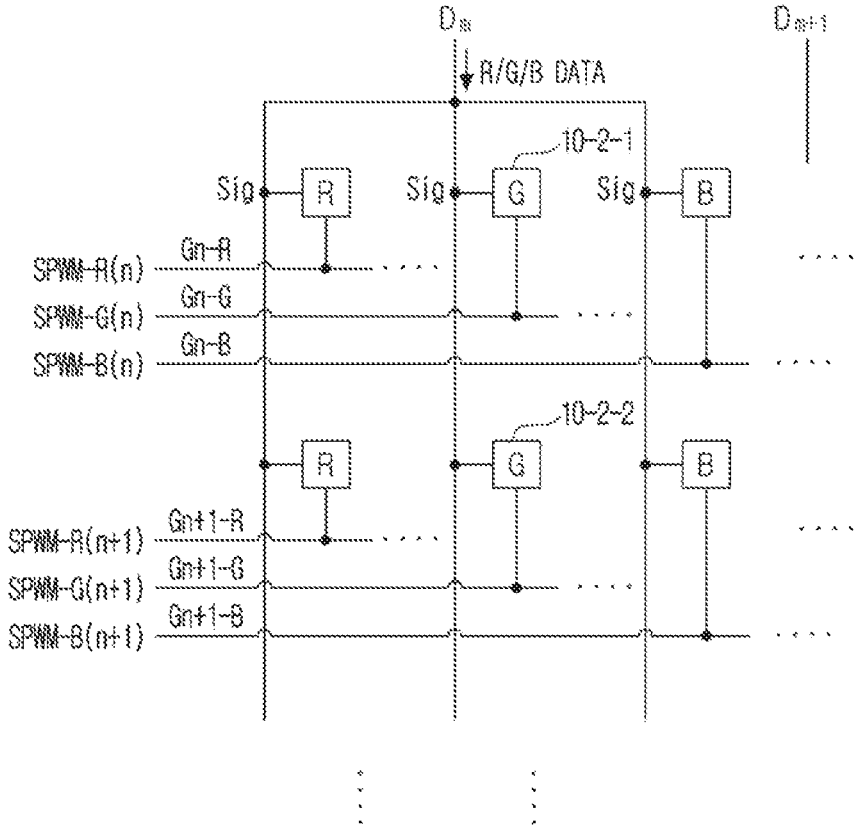
FIG. 19A is a diagram showing a part of a display panel that does not include the MUX circuit according to an embodiment.
Figure 19B:
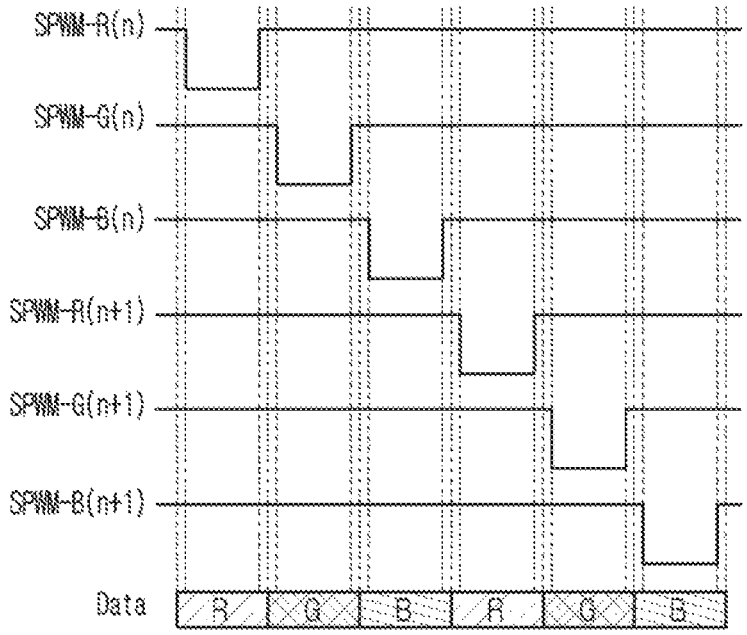
FIG. 19B is a diagram showing driving signals for driving the display panel of FIG. 19A according to an embodiment.

Further, as will be descried with reference to FIGS. 19A and 19B, in the display panel 100, the gate lines G1 to Gx for selecting the PWM circuits 111 for each line may be provided for each of the R sub-pixel, the G sub-pixel, and the B sub-pixel.

In the display panel 100, a power supply line through which the first power supply voltage VDD_PAM for driving the PAM circuit 112 is applied, and a power supply line through which the second power supply voltage VDD_PWM for driving the PWM circuit 111 may be provided for each pixel circuit 110.

The driver 200 drives the display panel 100 according to a control of the processor 900, and may include a timing controller 810, a source driver 820, a gate driver 830, a MUX circuit (not shown in FIG. 13), and a power supply circuit (not shown in FIG. 13).

The timing controller 810 may receive an input signal IS, a horizontal synchronization signal (Hsync), a vertical synchronization signal (Vsync), a main clock signal (MCLK), and the like from the outside, generate an image data signal, a scan control signal, a data control signal, a light emission control signal, and the like, and provide the generated signals to the display panel 100, the source driver 820, the gate driver 830, the power supply circuit, and the like.

Particularly, the timing controller 810 may generate various control signals (Emi, Vsweep, Vini, VST, Test, Discharging, and the like), and provide the control signals to the pixel circuit 110. Here, the voltage Vini may be a predetermined voltage between −5V and 0V, but is not limited thereto.

Further, the timing controller 810 may apply, to the MUX circuit, a control signal for selecting each of the R sub-pixel, the G sub-pixel, and the B sub-pixel, that is, a MUX signal (Mux (R), Mux (G), or Mux (B)). Therefore, each of the plurality of sub-pixels included in the pixel of the display panel 100 may be selected. However, the component of the driver 200 that provides the MUX signal is not limited to the timing controller 810. It is a matter of course that a separate component for generating and providing a MUX signal may be provided in the driver 200.

The source driver 820 (or data driver) generates a data signal. The source driver 820 receives image data with R/G/B components and the like from the processor 900 and generates a data signal (for example, a PWM data voltage signal and a PAM data voltage signal). Further, the source driver 820 may apply the generated data signal to each pixel circuit 110 of the display panel 100 through the data lines D1 to Dy. Here, the PWM data voltage may be a voltage between +8V corresponding to a black gradation and +15V corresponding to a white gradation, but is not limited thereto.

The gate driver 830 (or scan driver) may generate various control signals (SPWM(n), SPAM, and the like) for selecting pixels arranged in a matrix form for each gate line (or scan line), and apply the generated various control signals to each pixel circuit 110 of the display panel 100 through the gate lines G1 to Gx.

Particularly, according to an embodiment, the gate driver 830 may generate control signals SPWM(1) to SPWM(x), and sequentially apply the control signals SPWM(1) to SPWM(x) to the gate lines G1 to Gx connected to the PWM circuits 111, respectively, thereby sequentially selecting all of the PWM circuits 111 included in the display panel 100 for each line. Further, the gate driver 830 may generate control signals SPAM, and collectively apply the control signals SPAM to the gate lines G1 to Gx connected to the PAM circuits 112, respectively, thereby sequentially selecting all of the PAM circuits 112 included in the display panel 100.

The power supply circuit may provide the power supply voltage to the pixel circuit 110 included in the display panel 100. Particularly, the power supply circuit may generate the first power supply voltage VDD_PAM and the second power supply voltage VDD_PWM, and provide the first power supply voltage VDD_PAM and the second power supply voltage VDD_PWM to the PAM circuit 112 and the PWM circuit 111 of the display panel 100, respectively.

As described above, some or all of the data driver 820, the gate driver 830, the power supply circuit, the MUX circuit, the clock providing circuit (not shown in FIG. 13), and the sweep signal providing circuit (not shown in FIG. 13) may be included in the TFT layer 30 formed on one surface of the substrate 40 of the display panel 100, or may be implemented as a separate semiconductor integrated chip (IC) and disposed in a main printed circuit board (PCB) together with the timing controller 810 or the processor 900. However, embodiments are not limited to such an implementation example.

One display module 300 including the display panel 100 and the driver 200 may configure one display apparatus 1300. Further, according to an embodiment, a plurality of display modules 300 may be combined to configure one display apparatus 1300.

The processor 900 controls an overall operation of the display apparatus 1300. In particular, the processor 900 may control the driver 200 to drive the display panel 100.

To this end, the processor 900 may be implemented by one or more of a central processing unit (CPU), a microcontroller, an application processor (AP), a communication processor (CP), and an ARM processor.

FIG. 13 shows the case that the processor 900 and the timing controller 810 are separate components. However, according to an embodiment, the processor 900 may be omitted and the timing controller 810 may function as the processor 900.

Hereinafter, a driving method of the display panel 100 according to various embodiments will be described with reference to FIGS. 14 to 19C.

Figure 14:
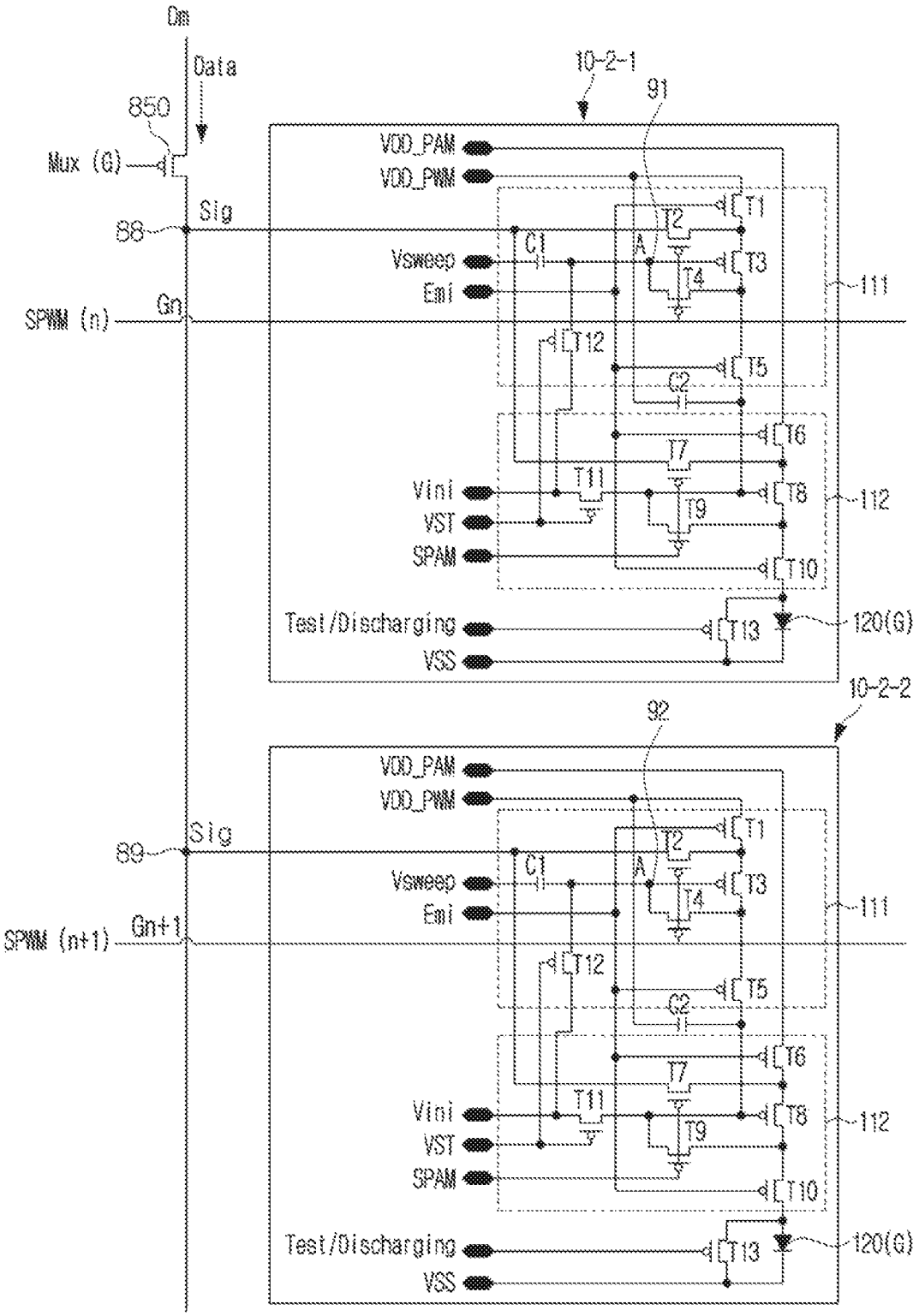
FIG. 14 is a diagram showing a part of the display panel according to an embodiment.

FIG. 14 is a diagram showing a part of the display panel 100 according to an embodiment.

Specifically, FIG. 14 shows G sub-pixels 10-2-1 and 10-2-2 among pixels formed in a first region in which a gate line Gn and a data line Dm intersect with each other and a second region in which a gate line Gn+1 and the data line Dm intersect with each other. Further, pixel circuits included in the G sub-pixels 10-2-1 and 10-2-2 are the pixel circuits 110 of FIG. 10A, and the gate line Gn and the gate line Gn+1 are gate lines connected to the PWM circuits 111 in the pixel circuits 110.

Figure 15A:
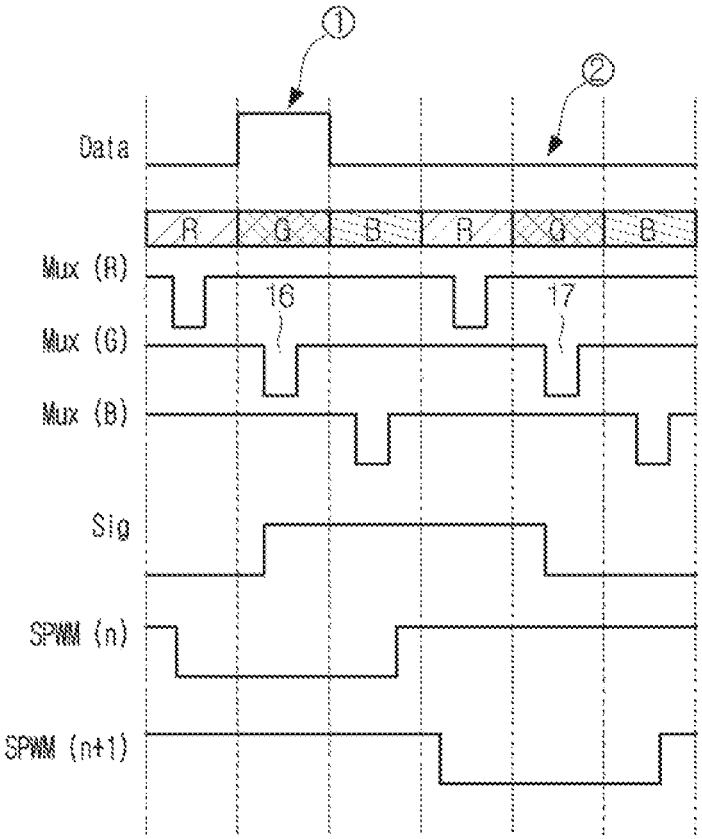
FIG. 15A is a diagram showing various driving signals for driving the display panel according to an embodiment.

According to an embodiment, the G sub-pixels 10-2-1 and 10-2-2 shown in FIG. 14 may be driven according to driving signals shown in FIG. 15A. FIG. 15A is a diagram showing various driving signals for driving the display panel 100 according to an embodiment.

Specifically, referring to FIG. 15A, control signals SPWM (n) and SPWM(n+1) generated by the gate driver 830 may be sequentially applied to the gate lines Gn and Gn+1, respectively. By doing so, the PWM circuits 111 of the pixels connected to the line Gn and the PWM circuits 111 of the pixels connected to the line Gn+1 may be sequentially selected for each line.

Here, while the line Gn is selected, the control signals Mux (R), Mux (G), and Mux (B) generated by the timing controller 810 may be sequentially applied to the MUX circuit and the R sub-pixel, the G sub-pixel, and the B sub-pixel included in each pixel connected to the line Gn may be sequentially selected. Therefore, a corresponding PWM data voltage may be time-shared and applied to the PWM circuit 111 of each sub-pixel through the data line Dm, and the same applies to the line Gn+1.

That is, according to an embodiment, the driver 200 may apply the signal SPWM(n) for selecting a plurality of pixels connected to one line Gn among the plurality of gate lines, to the line Gn.

Further, the driver 200 may sequentially apply, to the R sub-pixel, the G sub-pixel, and the B sub-pixel connected to the line Gn, the MUX signals Mux (R), Mux (G), and Mux (B) for selecting each of the plurality of sub-pixels connected to the line Gn, respectively.

Therefore, the driver 200 may apply a corresponding PWM data voltage to each of the R sub-pixel, the G sub-pixel, and the B sub-pixel connected to the line Gn.

The driver 200 may apply, to the line Gn+1, the signal SPWM(n+1) for selecting a plurality of pixels connected to the line Gn+1.

Further, the driver 200 may sequentially apply, to the R sub-pixel, the G sub-pixel, and the B sub-pixel connected to the line Gn+1, the signals Mux (R), Mux (G), and Mux (B) for selecting each of the plurality of sub-pixels connected to the line Gn+1, respectively.

Therefore, the driver 200 may apply a corresponding PWM data voltage to each of the R sub-pixel, the G sub-pixel, and the B sub-pixel connected to the line Gn+1.

FIG. 15A shows an example in which the signal SPWM (n) or SPWM(n+1) is applied before the MUX signals (that is, Mux (R), Mux (G), and Mux (B)) are applied, but the disclosure is not limited thereto. For example, as will be described later with reference to FIG. 16, the driver 200 may also apply the signals Mux (R), Mux (G), and Mux (B) first, before the signal SPWM(n) or SPWM(n+1).

FIG. 15A shows the relevant driving signals for a part of the display panel 100 shown in FIG. 14, that is, the G sub-pixels 10-2-1 and 10-2-2. However, a corresponding PWM data voltage may also be applied to each of other sub-pixels of the display panel 100 similarly to that described above, and each sub-pixel of the display panel 100 may emit light with a gradation corresponding to the PWM data voltage applied thereto during the light emission period.

Figure 15B:
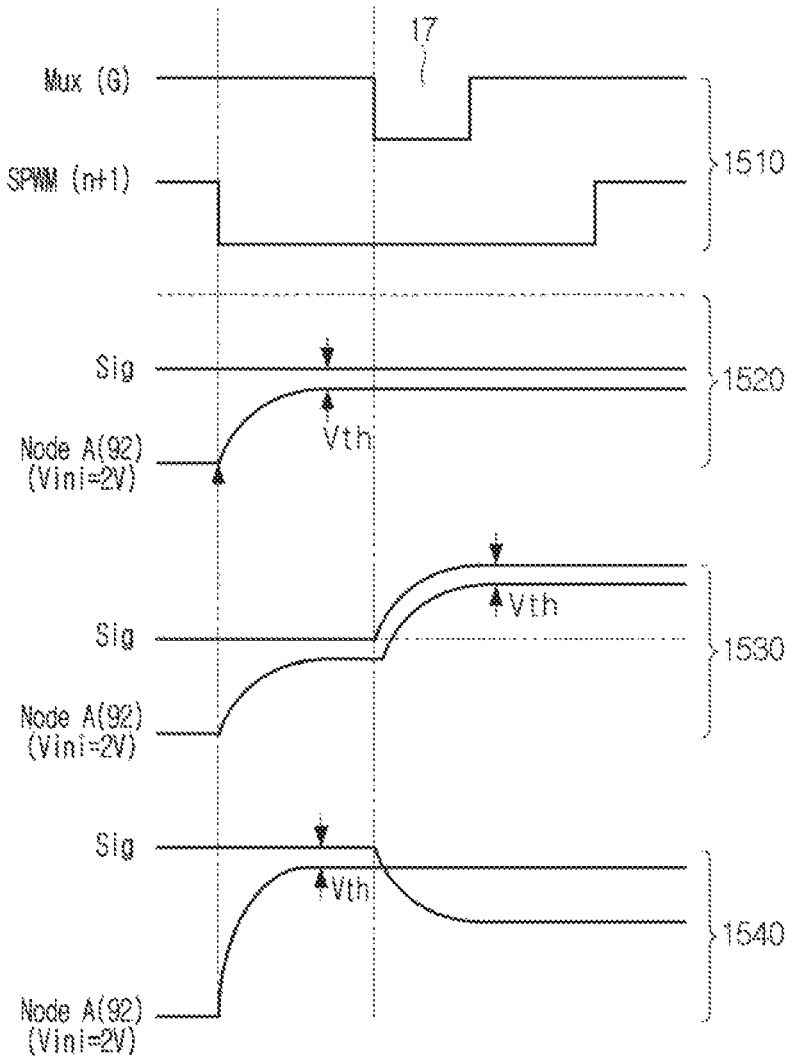
FIG. 15B is a diagram showing Sig and Node A voltages while driving the display panel of FIG. 14 as illustrated in FIG. 15A.

FIG. 15B is a diagram for describing a problem that may occur in the case of driving the display panel 100 of FIG. 14 as shown in FIG. 15A.

Referring to FIG. 14, a Sig terminal 88 of the G sub-pixel 10-2-1 and a Sig terminal 89 of the G sub-pixel 10-2-2 may be commonly connected to a rear stage of a MUX circuit 850 for selecting a G sub-pixel.

Therefore, a data voltage applied to the G sub-pixel 10-2-1 through the turned-on MUX circuit 850 after the line Gn may be selected according to the signal SPWM(n) remains in a floating state in the Sig terminals 88 and 89 until the MUX circuit 850 is turned on again and a corresponding data voltage is applied to the G sub-pixel 10-2-2 after the line Gn+1 is selected according to the signal SPWM(n+1).

Figure 16:
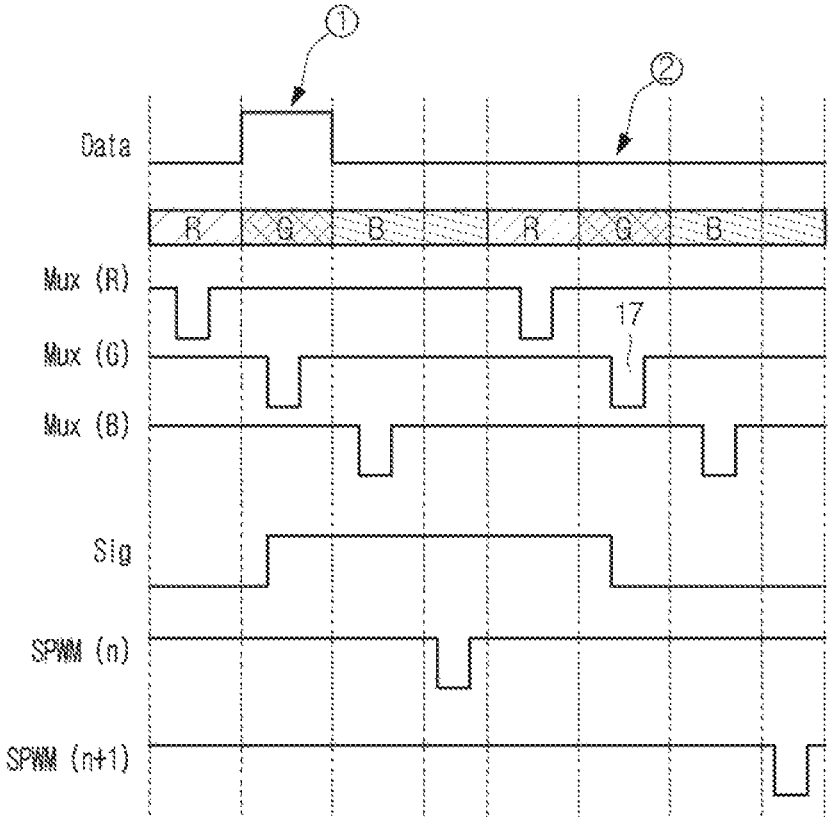
FIG. 16 is a diagram showing a driving method of the display panel according to an embodiment.
Figure 17A:
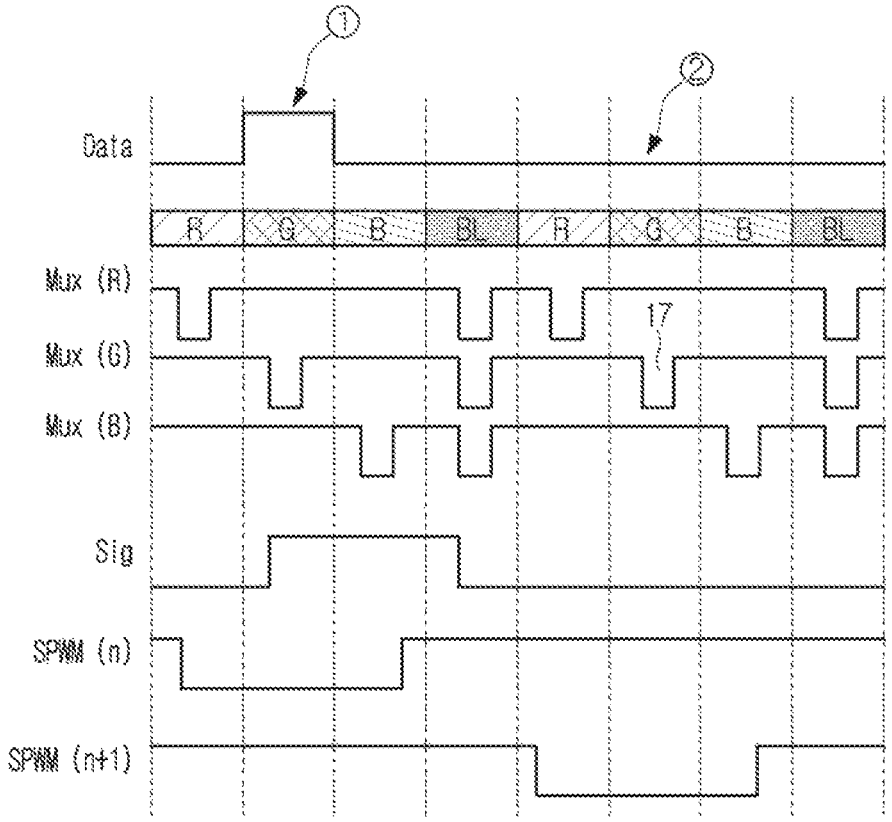
FIG. 17A is a diagram showing a driving method of the display panel according to another.
Figure 17B:
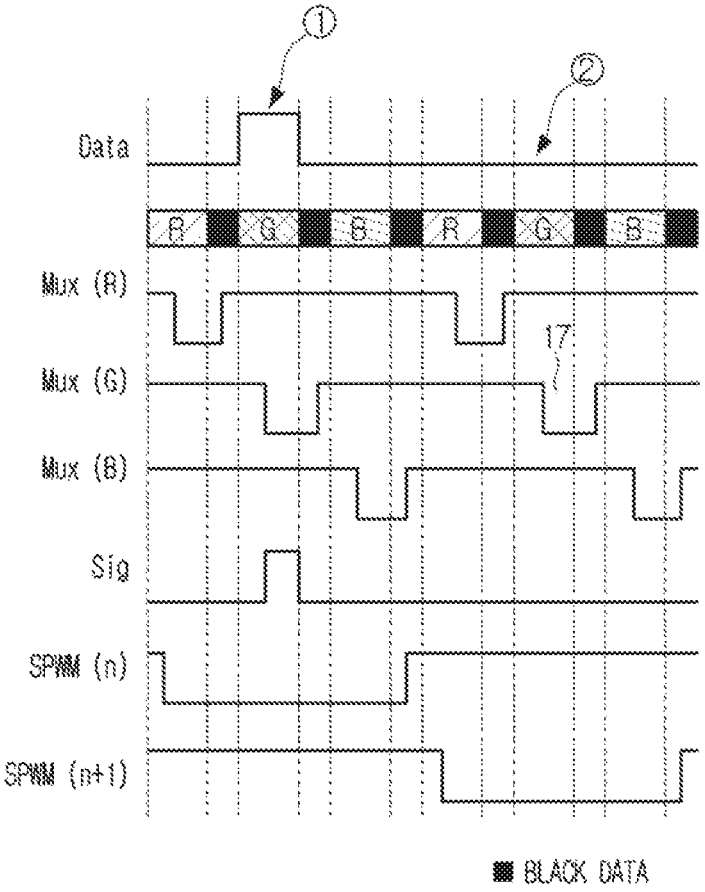
FIG. 17B is a diagram showing a driving method of the display panel according to still another embodiment of the disclosure.

A signal Sig of FIG. 15A indicates a signal of the Sig terminals 88 and 89 of the G sub-pixels 10-2-1 and 10-2-2 shown in FIG. 14 (the same applies to FIGS. 16, 17A, and 17B). That is, the Sig terminals 88 and 89 of the G sub-pixel 10-2-1 and the G sub-pixel 10-2-2 are commonly connected to the rear stage of the MUX circuit 850, and thus a signal of the Sig terminal 88 and a signal of the Sig terminal 89 are the same as each other as shown in FIG. 15A.

Specifically, referring to FIGS. 14 and 15A, once the signal SPWM(n) is applied to the line Gn, and a signal Mux (G) 16 is applied, a data voltage (①) applied to the data line Dm passes through the MUX circuit 850, the Sig terminal 88, a transistor T2, a transistor T3, and a transistor T4, and is applied to a node A 91 of the G sub-pixel 10-2-1.

Similarly, once the signal SPWM(n+1) is applied to the line Gn+1, and a signal Mux (G) 17 is applied, a data voltage (②) applied to the data line Dm passes through the MUX circuit 850, the Sig terminal 89, a transistor T2, a transistor T3, and a transistor T4, and is applied to a node A 92 of the G sub-pixel 10-2-2.

Here, referring to the signal Sig of FIG. 15A, the data voltage (①) applied to the Sig terminals 88 and 89 according to the signal Mux (G) 16 may remain in a floating state in the Sig terminals 88 and 89 before the signal Mux (G) 17 is applied and the data voltage (②) is applied.

In such a situation, even in a case where the signal SPWM(n+1) is applied to the line Gn+1 and the signal Mux (G) 17 is applied, the data voltage (②) may not necessarily be applied to the node A 92 of the G sub-pixel 10-2-2, which is problematic.

Such a problem will be described in detail as follows with reference to FIGS. 14 and 15B.

Reference numeral 1510 of FIG. 15B represents the signal SPWM(n+1) and the signal Mux (G) 17 of FIG. 15A, reference numerals 1520 to 1540 represent a voltage of the Sig terminal 89 and a voltage of the Node A 92 of the G sub-pixel 10-2-2 in a case where the data voltage (①) and the data voltage (②) change from low to low, from low to high, and from high to low, respectively.

Here, the terms "low" and "high" only represent a relative difference of the data voltage (①) and the data voltage (②), and do not represent specific values.

The initial voltage Vini may be generally lower than the lowest data voltage. Although FIG. 15B shows the case that the initial voltage Vini is +2V, the disclosure is not limited thereto.

Further, in 1520 to 1540, the voltage of the node A 92 is lower than the voltage of the Sig terminal by Vth, which shows that a threshold voltage Vth of the transistor T3 of the G sub-pixel 10-2-2 is compensated as described with reference to FIG. 7C.

Specifically, 1520 indicates the case that the data voltage (①) and the data voltage (②) are both low.

First, FIG. 15B shows that a low voltage may be floated in the Sig terminal 89. This is because the Sig terminal 88 and the Sig terminal 89 are commonly connected as described above.

Then, once the signal SPWM(n+1) is applied, the floated low voltage passes through the turned-on transistors T2, T3, and T4, and is applied to the node A 92 of the G sub-pixel 10-2-2. Here, the transistors T2 and T4 are turned on according to the signal SPWM(n+1), and the transistor T3 is turned on according to the voltage Vini.

Then, the data voltage does not change even in a case where the signal Mux (G) 17 applied, and thus the voltage of the node A 92 is maintained. In this case, a low voltage, which is desirable, is applied to the node A 92.

1530 indicates the case that the data voltage (①) is low and the data voltage (②) is high.

Also in this case, a low voltage is floated in the Sig terminal 89, because the data voltage (①) is low.

Once the signal SPWM(n+1) is applied, the floated low voltage passes through the turned-on transistors T2, T3, and T4, and is applied to the node A 92 of the G sub-pixel 10-2-2. Here, the transistors T2 and T4 are turned on according to the signal SPWM(n+1), and the transistor T3 is turned on according to the voltage Vini.

Then, once the signal Mux (G) 17 is applied, the data voltage (②), that is, a high voltage, is applied to the Sig terminal 89, and the applied high voltage passes through the turned-on transistors T2, T3, and T4, and is applied to the node A 92 of the G sub-pixel 10-2-2. In this case, the transistors T2 and T4 are turned on according to the signal SPWM(n+1). Here, the transistor T3 is turned on, because a low voltage is applied to the node A 92 (that is, a gate terminal of the transistor T3), and a high voltage is applied to a source terminal of the transistor T3 through the transistor T2.

Also in this case, a high voltage, which is desirable, is applied to the node A 92.

1540 indicates the case that the data voltage (①) is high and the data voltage (②) is low.

In this case, it may be seen that a high voltage is floated in the Sig terminal 89, because the data voltage (①) is high.

Then, once the signal SPWM(n+1) is applied, the floated high voltage passes through the turned-on transistors T2, T3, and T4, and is applied to the node A 92 of the G sub-pixel 10-2-2. Here, the transistors T2 and T4 are turned on according to the signal SPWM(n+1), and the transistor T3 is turned on according to the voltage Vini.

Then, once the signal Mux (G) 17 is applied, the data voltage (②), that is, a low voltage is applied to the Sig terminal 89.

In this case, however, the low voltage applied to the Sig terminal 89 is not transferred to the node A 92. This is because, although the transistors T2 and T4 are in a turned-on state according to the signal SPWM(n+1), a high voltage is applied to the node A 92 (that is, the gate terminal of the transistor T3), and thus the transistor T3 is not turned on even in a case where a low voltage is applied to the source terminal of the transistor T3 through the transistor T2.

Therefore, in a case where a relatively high data voltage (①) needs to be set for the G sub-pixel 10-2-1 of the line Gn, and a relatively low data voltage (②) needs to be set for the G sub-pixel 10-2-2 of the line Gn+1, a low data voltage may not be set for the G sub-pixel 10-2-2, which may result in a problem that the G sub-pixel 10-2-2 may not emit light with a desired gradation.

Hereinabove, although the problem has been described with the G sub-pixels 10-2-1 and 10-2-2 by way of example, it is a matter of course that the above-described problem may be caused in other pixels such as the R sub-pixel and the B sub-pixel as well.

FIGS. 16, 17A, and 17B each show a driving method of the display panel 100 capable of overcoming the problem described above with reference to FIG. 15B.

First, a method of modifying the control signals SPWM (n) and SPWM(n+1) for selecting gate lines as shown in FIG. 16 is described.

Specifically, in a case of the driving method shown in FIG. 15A, while the signal SPWM(n) is first applied to select the gate line Gn, the MUX signals Mux (R), Mux (G), and Mux (B) are sequentially applied, and a corresponding data voltage is applied to each of the R sub-pixel, the G sub-pixel, and the B sub-pixel. The same applies to the line Gn+1.

However, according to an embodiment, as shown in FIG. 16, the signal SPWM(n) for selecting the gate line Gn may be applied after the signals Mux (R), Mux (G), and Mux(B) for selecting the plurality of sub-pixels, respectively, are sequentially applied.

That is, the driver 200 may apply the signal SPWM(n) to the line Gn after sequentially applying, to the R sub-pixel, the G sub-pixel, and the B sub-pixel connected to the Gn line, the signals Mux (R), Mux (G), and Mux (B), respectively. Therefore, the driver 200 may apply a corresponding PWM data voltage to each of the R sub-pixel, the G sub-pixel, and the B sub-pixel connected to the Gn line. As shown in FIG. 16, the line Gn+1 may also be operated similarly to the operation of the line Gn described above.

Therefore, in a case where the signals Mux (R), Mux (G), and Mux (B) are turned off, data voltages applied to the Sig terminals, respectively, according to the turned-on signals Mux (R), Mux (G), and Mux (B) are floated in the Sig terminals, respectively. Then, the floated data voltages may be collectively applied to each of the R sub-pixel, the G sub-pixel, and the B sub-pixel according to the signal SPWM(n). The same applies to the line Gn+1.

In this case, the gate line may be selected after the data voltages are applied to the Sig terminals connected to the sub-pixels, respectively, and thus it is possible to prevent the problem that may be caused as a data voltage of the previous gate line floated in the Sig terminal is applied to the sub-pixel first.

For example, as shown in FIG. 16, even in a case where the data voltage (①) of the G sub-pixel 10-2-1 of the line Gn is high, and the data voltage (②) of the G sub-pixel 10-2-2 of the line Gn+1 is low, the signal SPWM(n+1) is applied after a floated high voltage becomes low according to the signal Mux (G) 17, and thus the floated low voltage may pass through the turned-on transistors T2, T3, and T4 and be applied to the node A 92 of the G sub-pixel 10-2-2.

The signals SPWM(n) and SPWM(n+1) for selecting gate lines may be applied after the signals Mux (R), Mux (G), and Mux(B) are sequentially applied by adjusting a data applying time for each of the R sub-pixel, the G sub-pixel, and the B sub-pixel, as shown in FIG. 16. FIG. 16 shows an example in which data are applied to the data line in order of R, G, and B, and thus the signals SPWM(n) and SPWM(n+1) are applied by spending a part of a data applying time corresponding to the B sub-pixel. However, the disclosure is not limited thereto.

As another method for overcoming the behavior described above with reference to FIG. 15B, a method of resetting (for example, applying black data) data applied to a sub-pixel as shown in FIGS. 17A and 17B may be performed.

Specifically, in a case of the driving method shown in FIG. 15A, the signal SPWM(n+1) is applied to the line Gn+1 before data of the G sub-pixel 10-2-2 of the line Gn+1 is applied to each of the Sig terminals 88 and 89 through the signal Mux (G). Therefore, data of the G sub-pixel 10-2-1 of the line Gn floated in each of the Sig terminals 88 and 89 is applied to the G sub-pixel 10-2-2 through the line Gn+1, which causes the behavior shown in 1540 of FIG. 15B. The same applies to the R sub-pixel and the B sub-pixel.

Therefore, the above-described behavior may be prevented by resetting, to a low voltage, the data applied to the line Gn, that is, the voltage floated in each of the Sig terminals 88 and 89, before the signal SPWM(n+1) is applied.

Here, the voltage floated in each of the Sig terminals 88 and 89 may be reset in a pixel unit as shown in FIG. 17A, or may be reset in a sub-pixel unit as shown in FIG. 17B.

Specifically, according to an embodiment, as shown in FIG. 17A, the driver 200 may sequentially apply the signals Mux (R), Mux (G), and Mux(B) for selecting the R sub-pixel, the G sub-pixel, and the B sub-pixel, respectively, while the signal SPWM(n) is applied and a plurality of pixels connected to the line Gn are selected, thereby applying a corresponding data voltage to each of the R sub-pixel, the G sub-pixel, and the B sub-pixel.

Before the signal SPWM(n+1) is applied, the driver 200 may collectively apply the signals Mux (R), Mux (G), and Mux (B), thereby applying a reset data voltage (for example, black voltage) to each of the R sub-pixel, the G sub-pixel, and the B sub-pixel.

That is, before the signal SPWM(n+1) is applied, the driver 200 may collectively apply the signals Mux (R), Mux (G), and Mux (B), thereby resetting all PWM data voltages floated in the respective Sig terminals of the R sub-pixel, the G sub-pixel, and the B sub-pixel to low voltages (for example, black (BL) voltages).

In this case, the black voltage may be applied to the data line Dm by the source driver 820 while the signals Mux (R), Mux (G), and Mux (B) are collectively applied.

As shown in FIG. 17A, the line Gn+1 may also be operated similarly to the operation of the line Gn described above.

In this case, all data voltages of the previous gate line floated in the Sig terminals after the data voltages are applied to the respective sub-pixels are reset to the black voltages, and thus the behavior shown in 1540 of FIG. 15B does not occur.

For example, as shown in FIG. 17A, in the case that the data voltage (①) of the G sub-pixel 10-2-1 of the line Gn is high, and the data voltage (②) of the G sub-pixel 10-2-2 of the line Gn+1 is low, the signal SPWM(n+1) is applied after a floated high voltage is reset to the black voltage, and thus the low data voltage (②) applied according to the signal Mux (G) 17 may pass through the turned-on transistors T2, T3, and T4 and be applied to the node A 92 of the G sub-pixel 10-2-2.

The signals Mux (R), Mux (G), and Mux (B) for collective selecting the R sub-pixel, the G sub-pixel, and the B sub-pixel may be applied after the signals Mux (R), Mux (G), and Mux (B) are sequentially applied by adjusting a data applying time for each of the R sub-pixel, the G sub-pixel, and the B sub-pixel, as shown in FIG. 17A.

According to another embodiment, as shown in FIG. 17B, the driver 200 may sequentially apply the signals Mux (R), Mux (G), and Mux (B) for selecting the R sub-pixel, the G sub-pixel, and the B sub-pixel, respectively, while the signal SPWM(n) is applied and a plurality of pixels connected to the line Gn are selected, thereby applying a corresponding data voltage and a reset data voltage (for example, black voltage) to each of the R sub-pixel, the G sub-pixel, and the B sub-pixel.

In this case, it is a matter of course that a data voltage corresponding to the R sub-pixel and the black voltage may be sequentially applied to the data line Dm by the source driver 820 while the signal Mux (R) is applied, a data voltage corresponding to the G sub-pixel and the black voltage may be sequentially applied to the data line Dm by the source driver 820 while the signal Mux (G) is applied, and a data voltage corresponding to the B sub-pixel and the black voltage may be sequentially applied to the data line Dm by the source driver 820 while the signal Mux (B) is applied.

As shown in FIG. 17B, the line Gn+1 may also be operated similarly to the operation of the line Gn described above.

In this case, all black voltages are applied after the data voltages are applied to the R sub-pixel, the G sub-pixel, and the B sub-pixel, respectively. Therefore, a reset data voltage (for example, a black voltage, that is, the lowest data voltage) is floated in each Sig terminal, and thus the problem such as 1540 in FIG. 15B does not occur.

Specifically, for example, as shown in FIG. 17B, in the case that the data voltage (①) of the G sub-pixel 10-2-1 of the line Gn is high, and the data voltage (②) of the G sub-pixel 10-2-2 of the line Gn+1 is low, the black voltage is floated in each of the Sig terminals 88 and 89, and thus the low data voltage (②) applied according to the signal Mux (G) 17 after the signal SPWM(n+1) is applied may pass through the turned-on transistors T2, T3, and T4 and be applied to the node A 92 of the G sub-pixel 10-2-2.

In the case that the black data voltage is applied immediately after the data voltage is applied to each sub-pixel, there is no problem in the operation of the display panel 100.

Referring to FIGS. 14 and 17B, while the signal SPWM (n) is applied to the line Gn, and the signal Mux (G) is applied, a data voltage (①) applied to the data line Dm passes through the MUX circuit 850, the Sig terminal 88, the transistor T2, the transistor T3, and the transistor T4, and is applied to the node A 91 of the G sub-pixel 10-2-1. Here, the transistors T2 and T4 are turned on according to the signal SPWM(n), and the transistor T3 is turned on according to the voltage Vini.

Then, the black voltage applied to the data line Dm is applied to the Sig terminal 88 through the MUX circuit 850, but is not applied to the node A 91 of the G sub-pixel 10-2-1. This is because a data voltage (①) higher than the black voltage is already applied to the node A 91 (that is, the gate terminal of the transistor T3), and thus the transistor T3 is not turned on even in a case that the black voltage is applied to the source terminal of the transistor T3 through the transistor T2.

That is, only a desired data voltage is applied to the node A 91 of the G sub-pixel 10-2-1, and the black voltage may be reset for the Sig terminals 88 and 89. The same applies to the R sub-pixel or the B sub-pixel.

The reset data voltage may be applied by adjusting the data applying time for each of the R sub-pixel, the G sub-pixel, and the B sub-pixel as shown in FIG. 17B.

In the case of the driving method described with reference to FIG. 16, the data voltage is floated in the Sig terminal first, and then the floated data voltage is applied to each sub-pixel. Therefore, in the case that the display module 300 is implemented by a gate in panel (GIP) method in which the gate driver is disposed in the display panel 100, a luminance non-uniformity (mura) may be caused at the time of the operation of the display panel 100.

However, in the method described with reference to FIGS. 17A and 17B, an image may be displayed without the luminance non-uniformity in the case that the display module 300 is implemented by the GIP method.

Hereinafter, a driving method of a display panel 100 according to still another embodiment will be described with reference to FIGS. 18A to 18H.

Figure 18A:
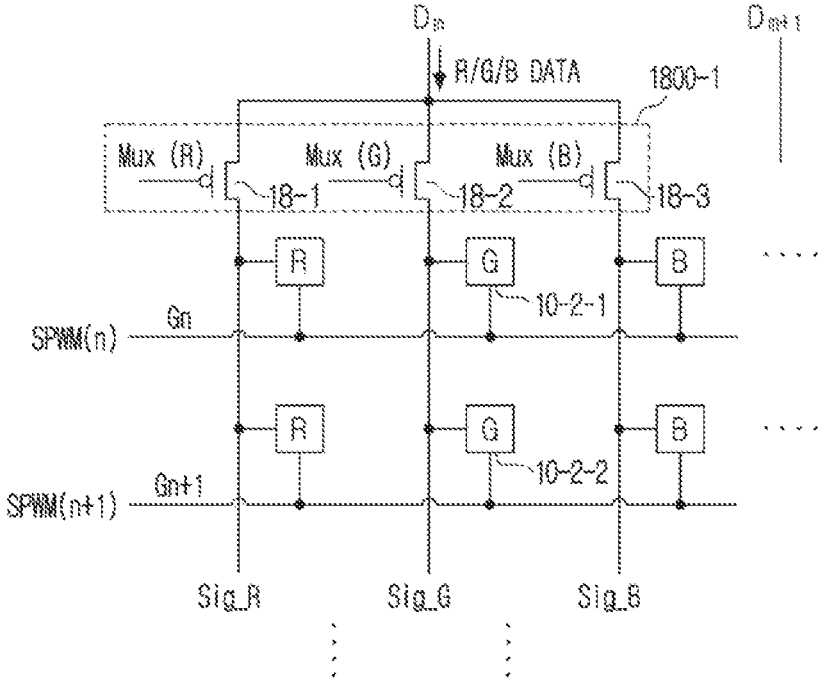
FIG. 18A is a diagram showing a part of a display panel according to an embodiment.

FIG. 18A is a diagram showing a part of the display panel 100 according to an embodiment. Referring to FIG. 18A, a data voltage for each of an R sub-pixel, a G sub-pixel, and a B sub-pixel may be time-division-multiplexed and applied to the display panel 100 through one data line Dm.

Here, the display panel 100 includes a MUX circuit 1800-1 for applying, to a data signal line Sig_R of the R sub-pixel, a data signal line Sig_G of the G sub-pixel, and a data signal line Sig_B of the B sub-pixel, respectively, data voltages that are time-division-multiplexed, are applied to the data line Dm, and correspond to the R sub-pixel, the G sub-pixel, and the B sub-pixel, respectively, according to MUX signals Mux (R), Mux (G), and Mux (B).

Specifically, the MUX circuit 1800-1 includes a transistor 18-1 having a source terminal connected to the data line Dm, a drain terminal connected to the data signal line Sig_R of the R sub-pixel, and a gate terminal connected to a signal line Mux (R); a transistor 18-2 having a source terminal connected to the data line Dm, a drain terminal connected to the data signal line Sig_G of the G sub-pixel, and a gate terminal connected to a signal line Mux (G); and a transistor 18-3 having a source terminal connected to the data line Dm, a drain terminal connected to the data signal line Sig_B of the B sub-pixel, and a gate terminal connected to a signal line Mux (B).

Therefore, each of the time-division-multiplexed R data voltage, G data voltage, and B data voltage applied through the data line Dm may be applied to each corresponding sub-pixel as the MUX signals Mux (R), Mux (G), and Mux (B) are sequentially applied to the MUX circuit 1800-1 at corresponding timings.

Specifically, the driver 200 may apply the control signal Mux (R) for selecting the R sub-pixel to the MUX circuit 1800-1 of the display panel 100 during a time for which the R data voltage is applied to the data line Dm, apply the control signal Mux (G) for selecting the G sub-pixel to the MUX circuit 1800-1 during a time for which the G data voltage is applied to the data line Dm, and apply the control signal Mux (B) for selecting the B sub-pixel to the MUX circuit 1800-1 during a time for which the B data voltage is applied to the data line Dm. By doing so, a corresponding data voltage may be applied to each sub-pixel. Here, a control signal SPWM applied to each sub-pixel has been described above through various embodiments, and thus an overlapping description will be omitted.

As described above, the time-division-multiplexed R data voltage, G data voltage, and B data voltage applied through one data line Dm are applied to corresponding sub-pixels, respectively. However, a voltage different from the data voltage applied to the data line Dm may be applied to each sub-pixel in the display panel 100 having the structure as shown in FIG. 18A.

Figure 18B:
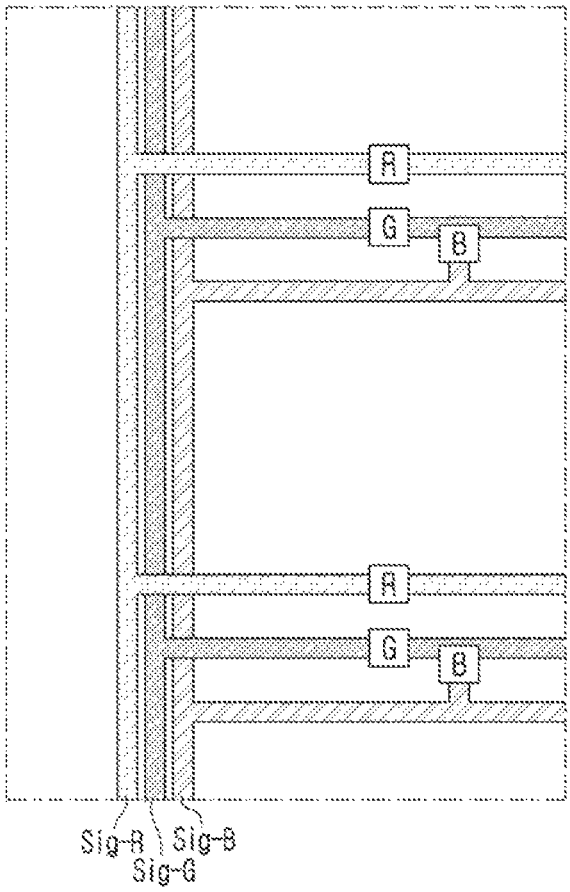
FIG. 18B is a diagram showing arrangement of Sig lines in the display panel according to an embodiment.

Specifically, according to an embodiment, Sig signal lines (or Sig signal wirings) of the R sub-pixel, the G sub-pixel, and the B sub-pixel included in one pixel may be formed adjacent to each other in the display panel 100 as shown in FIG. 18B.

In this case, a parasitic capacitance may be generated between adjacent or overlapping lines Sig_R, Sig_G, and Sig_B, and in this case, a data voltage applied to one of the Sig lines Sig_R, Sig_G, and Sig_B may be coupled to another Sig line.

Figure 18C:
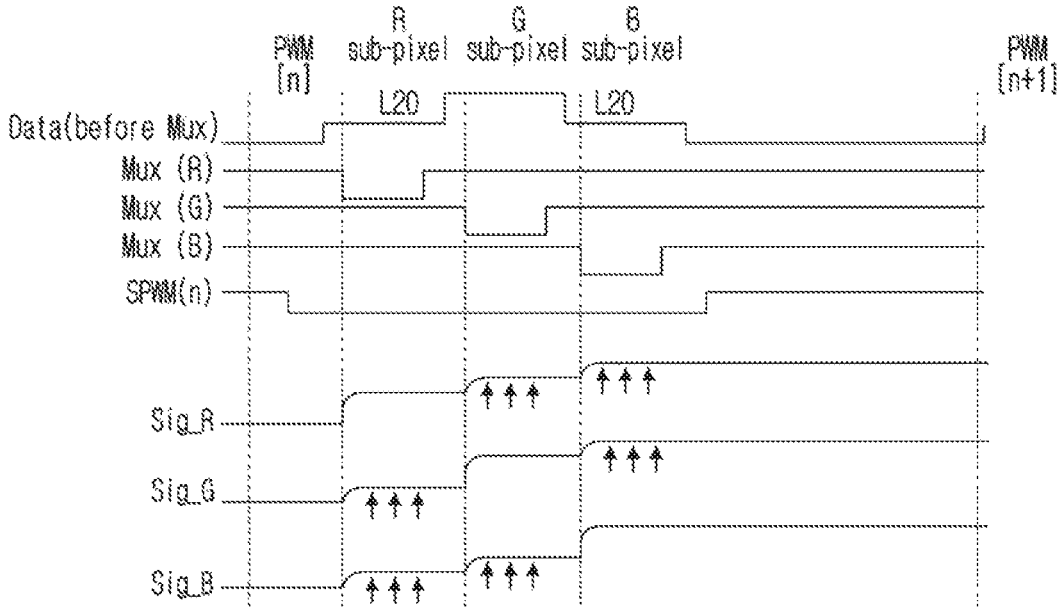
FIG. 18C is a diagram showing a change of a data voltage caused by coupling.

FIG. 18C shows a change of a data voltage caused by coupling. Referring to FIG. 18C, data voltages that are time-division-multiplexed, are applied to the data line Dm, and correspond to the R sub-pixel, the G sub-pixel, and the B sub-pixel, respectively, and are sequentially applied to the Sig lines Sig_R, Sig_G, and Sig_B corresponding to the R sub-pixel, the G sub-pixel, and the B sub-pixel, respectively, according to the MUX signals Mux (R), Mux (G), and Mux (B) sequentially applied while the control signal SPWM(n) is applied.

Here, as indicated by upward arrows of FIG. 18C, a data voltage applied to one of the Sig lines Sig_R, Sig_G, and Sig_B is reflect in the other Sig. lines through coupling.

Therefore, in a case where the data voltages are the same as each other, there may be a difference in a sum of brightnesses of the R sub-pixel, the G sub-pixel, and the B sub-pixel between the case that the R sub-pixel, the G sub-pixel, and the B sub-pixel are driven separately versus the case that R sub-pixel, the G sub-pixel, and the B sub-pixel are driven simultaneously.

For example, assuming that a data voltage for a brightness of 100 nit is applied to each of the R sub-pixel, the G sub-pixel, and the B sub-pixel included in one pixel, in a case where the R sub-pixel, the G sub-pixel, and the B sub-pixel are driven separately, the sum of the brightnesses of the R sub-pixel, the G sub-pixel, and the B sub-pixel is 300 nit. Therefore, in a case that the R sub-pixel, the G sub-pixel, and the B sub-pixel are driven simultaneously (for example, even in a case of implementing a white (W) color), the sum of the brightnesses of the R sub-pixel, the G sub-pixel, and the B sub-pixel should be 300 nit. However, in a case of simultaneously driving the R sub-pixel, the G sub-pixel, and the B sub-pixel in actual implementation, the sum of the brightnesses of the R sub-pixel, the G sub-pixel, and the B sub-pixel may exceed 300 nit due to the above-described data voltage coupling, and as a result, a brightness value of R, G, and B may be different from a brightness value of W.

Figure 18D:
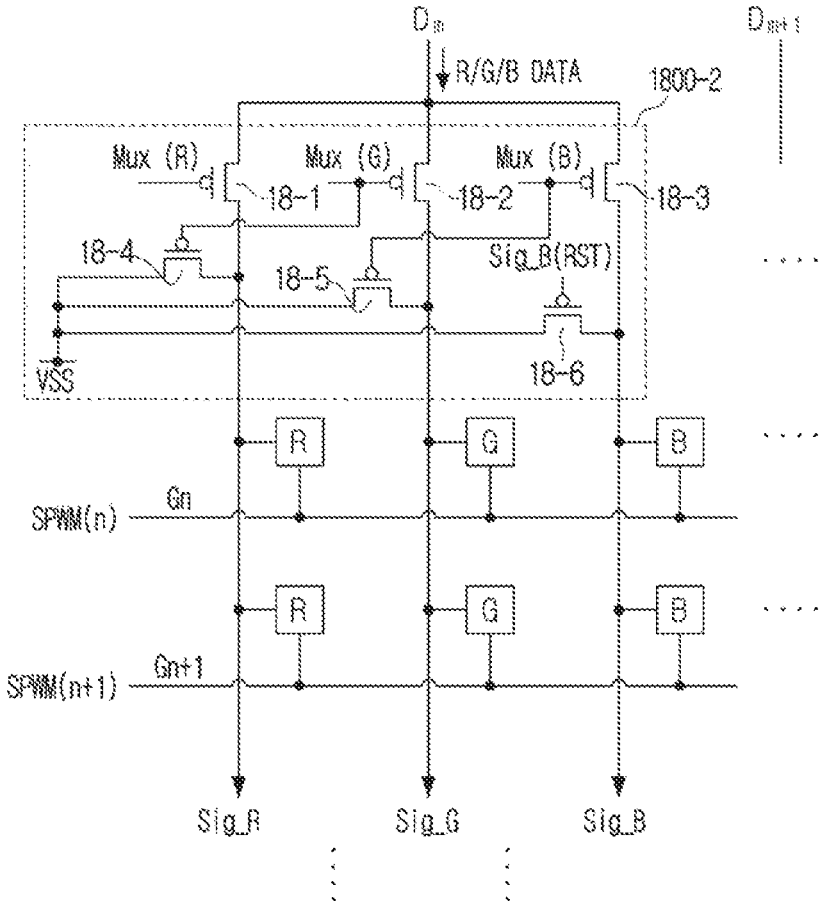
FIG. 18D is a diagram showing a part of a display panel according to another embodiment.

FIG. 18D is a diagram showing a part of a display panel 100 according to another embodiment. The display panel 100 shown in FIG. 18D is practically the same as the display panel 100 shown in FIG. 18A with only difference being MUX circuit 1800-2.

Referring to FIG. 18D, the MUX circuit 1800-2 includes transistors 18-4 to 18-6 for resetting voltages of Sig lines Sig_R, Sig_G, and Sig_B, in addition to those of the MUX circuit 1800-1 of FIG. 18A. Here, a reset voltage may be a ground voltage VSS, but is not limited thereto.

Specifically, the transistor 18-4 has a source terminal connected to a ground voltage (VSS) terminal, a drain terminal connected to the line Sig_R, and a gate terminal connected to a signal line Mux (G). The transistor 18-5 has a source terminal connected to the ground voltage (VSS) terminal, a drain terminal connected to the line Sig_G, and a gate terminal connected to a signal line Mux (B). The transistor 18-6 has a source terminal connected to the ground voltage (VSS) terminal, a drain terminal connected to the line Sig_B, and a gate terminal connected to a signal line Sig_B (RST).

Figure 18E:
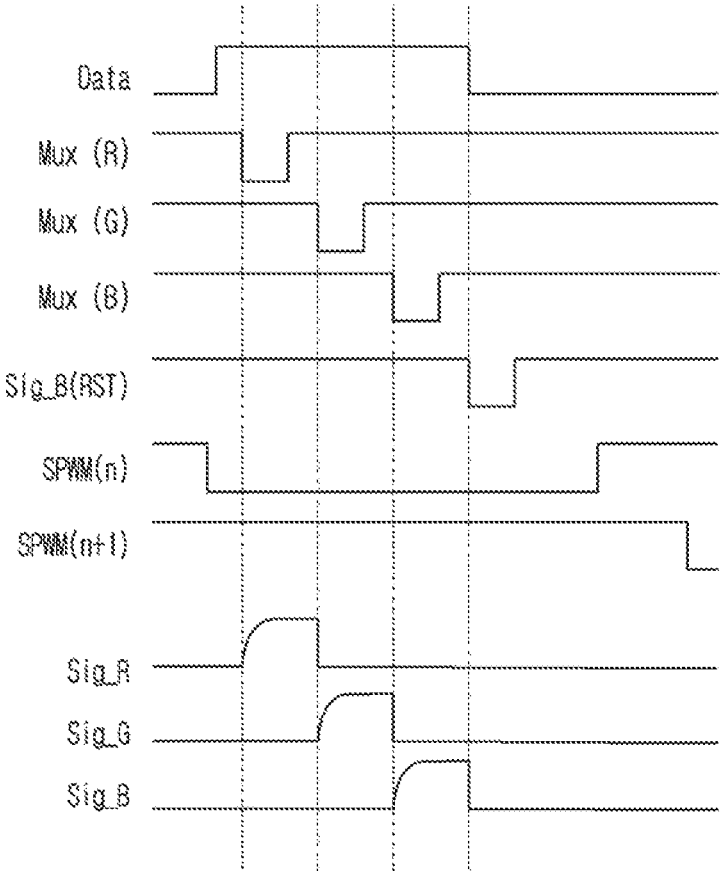
FIG. 18E is a driving timing diagram of the display panel shown in FIG. 18D according to an embodiment.

FIG. 18E is a driving timing diagram of the display panel shown in FIG. 18D according to an embodiment. Referring to FIG. 18E, MUX signals Mux (R), Mux (G), Mux (B), and Sig_B (RST) are sequentially applied to the MUX circuit 1800-2 while a signal SPWM(n) for selecting a line Gn is applied.

Specifically, while a signal Mux (R) is applied to the MUX circuit 1800-2 (specifically, the transistor 18-1), a data voltage corresponding to an R sub-pixel is applied to the line Sig_R through a data line Dm, and a data voltage applied to the line Sig_R is set for the R sub-pixel.

Then, while a signal Mux (G) is applied to the MUX circuit 1800-2 (specifically, the transistor 18-2), a data voltage corresponding to a G sub-pixel is applied to the line Sig_G through the data line Dm, and a data voltage applied to the line Sig_G is set for the G sub-pixel. At the same time, as the transistor 18-4 is turned on according to the signal Mux (G), a voltage of the line Sig_R is reset to the ground voltage VSS. Therefore, the data voltage applied to the line Sig_G is not coupled to the line Sig_R anymore.

Similarly, while a signal Mux (B) is applied to the MUX circuit 1800-2 (specifically, the transistor 18-3), a data voltage corresponding to a B sub-pixel is applied to the line Sig_B through the data line Dm, and a data voltage applied to the line Sig_B is set for the B sub-pixel. Further, as the transistor 18-5 is turned on according to the signal Mux (B), a voltage of the line Sig_G is reset to the ground voltage VSS. Therefore, the data voltage applied to the line Sig_B is not coupled to the line Sig_R or the line Sig_G anymore.

Finally, once a Sig_B reset signal, that is, a signal Sig_B (RST) is applied to the MUX circuit 1800-2 (specifically, the transistor 18-6), the transistor 18-6 is turned on, and a voltage of the line Sig_B is also reset to the ground voltage VSS.

As such, according to an embodiment, the data voltages applied to the lines Sig_R, Sig_G, Sig_B, respectively, may not be coupled to other Sig lines. Therefore, a brightness difference between the case that the R sub-pixel, the G sub-pixel, and the B sub-pixel are driven separately and the case that R sub-pixel, the G sub-pixel, and the B sub-pixel are driven simultaneously, due to the voltage coupling among the Sig lines may not occur.

As shown in FIGS. 18D and 18E, all of the voltages of the lines Sig_R, Sig_G, and Sig_B may be reset before the signal SPWM(n+1) for selecting the line Gn+1 is applied. Therefore, according to the embodiment described with reference to FIGS. 18D and 18E, the behavior described with reference to FIG. 15D does not occur.

Figure 18F:
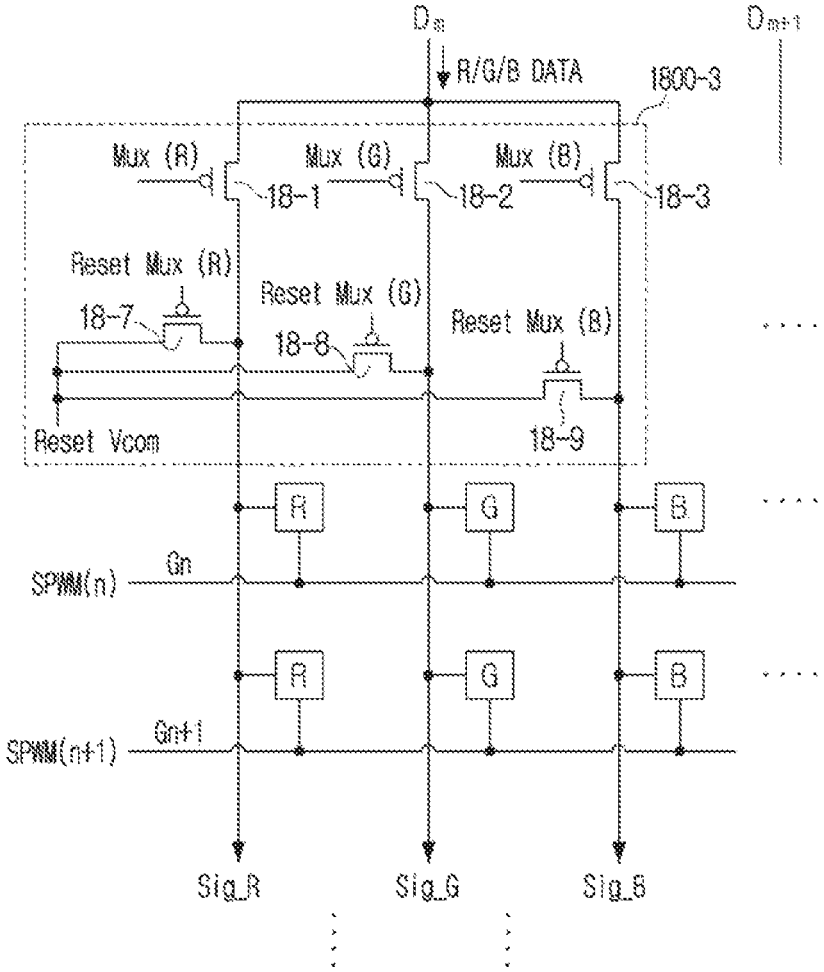
FIG. 18F is a diagram showing a part of a display panel according to still another embodiment.

FIG. 18F is a circuit diagram showing a part of a display panel according to another embodiment. Referring to FIG. 18F, a MUX circuit 1800-3 includes transistors 18-7 to 18-9 for resetting voltages of Sig lines Sig_R, Sig_G, and Sig_B, in addition to those of the MUX circuit 1800-1 of FIG. 18A. Here, as a reset voltage, any voltage between a black data voltage and a ground voltage VSS (for example, 0 [V]) may be used.

Specifically, in the embodiment shown in FIG. 18F, the transistor 18-7 has a source terminal connected to a signal line Reset Vcom to which the reset voltage is applied, a drain terminal connected to the line Sig_R, and a gate terminal connected to a signal line Reset Mux (R) to which a control signal for resetting a voltage of the line Sig_R. Further, the transistor 18-8 has a source terminal connected to the signal line Reset Vcom to which the reset voltage is applied, a drain terminal connected to the line Sig_G, and a gate terminal connected to a signal line Reset Mux (G) to which a control signal for resetting a voltage of the line Sig_G. Further, the transistor 18-9 has a source terminal connected to the signal line Reset Vcom to which the reset voltage is applied, a drain terminal connected to the line Sig_B, and a gate terminal connected to a signal line Reset Mux (B) to which a control signal for resetting a voltage of the line Sig_B is applied.

Therefore, referring to FIG. 18F, once signals Mux (R), Mux (G), and Mux (B) are applied to the transistors 18-1 to 18-3 of the Mux circuit 1800-3, corresponding voltages are set for the R sub-pixel, the G sub-pixel, and the B sub-pixel through the lines Sig_R, Sig_G, and Sig_B, respectively. Once the signals Reset Mux (R), Reset Mux (G), and Reset Mux (B) are applied to the transistors 18-7 to 18-9 of the MUX circuit 1800-3, voltages of the lines Sig_R, Sig_G, and Sig_B are each reset to the reset voltage to be applied through the signal line Reset Vcom.

Figure 18G:
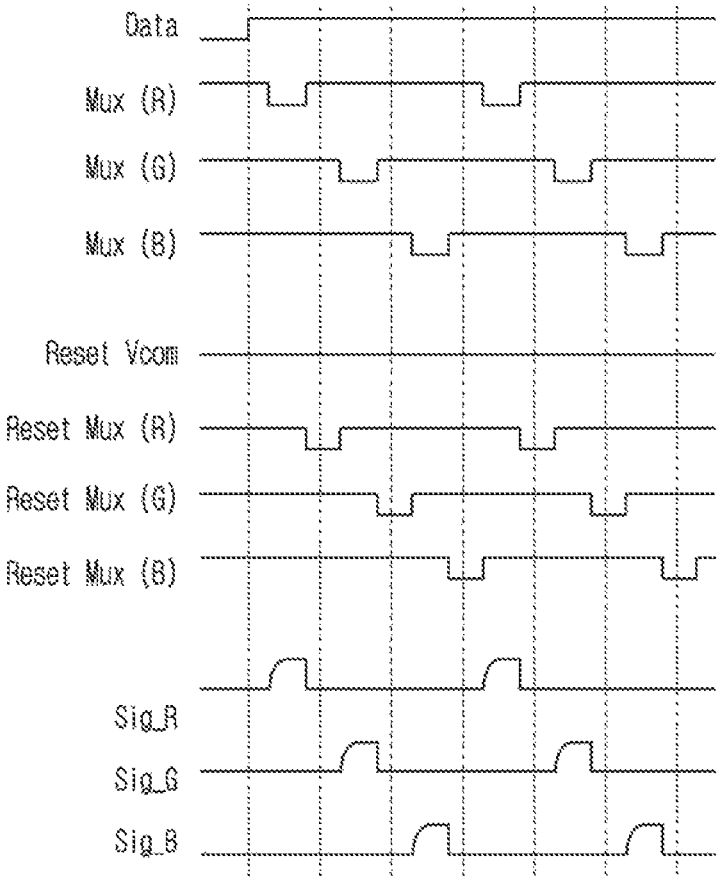
FIG. 18G is a driving timing diagram of the display panel shown in FIG. 18F according to an embodiment.
Figure 18H:
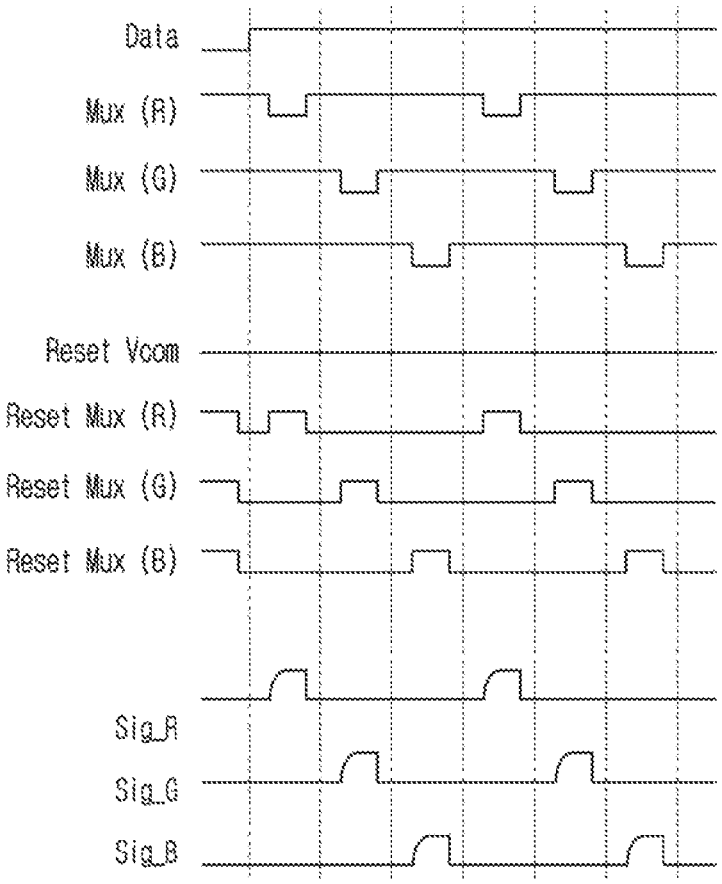
FIG. 18H is a driving timing diagram of the display panel shown in FIG. 18F according to another embodiment.

FIGS. 18G and 18H show driving timing diagrams of the display panel shown in FIG. 18F according to various embodiments.

Referring to FIGS. 18F to 18H, corresponding data voltages are applied to the lines Sig_R, Sig_G, and Sig_B according to the signals Mux (R), Mux (G), and Mux (B), and the reset voltages are applied according to the signals Reset Mux (R), Reset Mux (G), and Reset Mux (B).

Specifically, according to an embodiment, the driver 200 may apply the signal Reset Mux (R) to the transistor 18-7 before the signal Mux (G) is applied to the transistor 18-2 after the signal Mux (R) is applied to the transistor 18-1, apply the signal Reset Mux (G) to the transistor 18-8 before the signal Mux (B) is applied to the transistor 18-3 after the signal Mux (G) is applied to the transistor 18-2, and apply the signal Reset Mux (B) to the transistor 18-9 before the signal Mux (R) is applied to the transistor 18-1 after the signal Mux (B) is applied to the transistor 18-3, as shown in FIG. 18G.

According to another embodiment, the driver 200 may apply the signal Reset Mux (R) to the transistor 18-7 in time periods in which the signal Mux (R) is not applied to the transistor 18-1, apply the signal Reset Mux (G) to the transistor 18-8 in time periods in which the signal Mux (G) is not applied to the transistor 18-2, and apply the signal Reset Mux (B) to the transistor 18-9 at time periods in which the signal Mux (B) is not applied to the transistor 18-3, as shown in FIG. 18H.

Therefore, in the embodiments shown in FIGS. 18G and 18H, the voltages of the each of lines Sig_R, Sig_G, and Sig_B are individually reset to the reset voltages while the data voltages are applied to other Sig lines.

Therefore, a brightness difference between the case that the R sub-pixel, the G sub-pixel, and the B sub-pixel are driven separately and the case that R sub-pixel, the G sub-pixel, and the B sub-pixel are driven simultaneously, due to the voltage coupling among the Sig lines, and the behavior described above with reference to FIG. 15B may not occur in the embodiments shown in FIGS. 18F-H.

Hereinabove, the embodiments, in which the case that the data voltages to be applied to the R sub-pixel, the G sub-pixel, and the B sub-pixel, respectively, are time-shared and applied to the display panel 100 through one data line, and a corresponding data voltage is applied to each sub-pixel by using the MUX circuit, have been described with reference to FIGS. 14 to 18H. However, according to another embodiment, a corresponding data voltage may be applied to each sub-pixel without using the MUX circuit.

FIG. 19A is a circuit diagram showing a part of a display panel 100 that may apply a corresponding data voltage to each sub-pixel without the MUX circuit according to an embodiment, and FIG. 19B is a timing diagram of a control signal SPWM for driving the display panel 100 of FIG. 19A.

Referring to FIG. 19A, a data voltage for each of the R sub-pixel, the G sub-pixel, and the B sub-pixel is time-division-multiplexed and applied to the display panel 100 through one data line Dm, similarly to FIG. 18.

However, the display panel 100 shown in FIG. 19A does not include the MUX circuit, unlike the display panel 100 of FIG. 18. Instead, the display panel 100 of FIG. 19A includes separate gate lines Gn-R, Gn-G, and Gn-B for the respective types of sub-pixels, and a corresponding data voltage may be applied to each sub-pixel according to each of control signals SPWM-R(n), SPWM-G(n), and SPWM-B(n) applied through the separate gate lines provided as described above. The same applies to the n+1-th line.

Specifically, according to an embodiment, the driver 200 (specifically, the gate driver 830) may generate the control signal SPWM-R(n) for selecting R sub-pixels among a plurality of sub-pixels connected to an n-th gate line, the control signal SPWM-G(n) for selecting G sub-pixels, and the control signal SPWM-B(n) for selecting B sub-pixels, and sequentially apply the control signals SPWM-R(n), SPWM-G(n), and SPWM-B(n) to a line Gn-R, a line Gn-G, and a line Gn-B of FIG. 19A, respectively, as shown in FIG. 19B.

Here, the driver 200 may apply the control signal SPWM-R(n) to the line Gn-R while the R data voltage is applied to the data line Dm, apply the control signal SPWM-G(n) to the line Gn-G while the G data voltage is applied to the data line Dm, and apply the control signal SPWM-B(n) to the line Gn-B while the B data voltage is applied to the data line Dm, thereby applying a corresponding data voltage to each of the plurality of sub-pixels connected to the n-th line. The same applies to the n+1-th line.

As an example, the operation of the G sub-pixel of the n-th line of FIG. 19A, under the assumption that the underlying circuit is similar to the circuit shown in FIG. 14 with no MUX circuit 850, will be described. Specifically, once the control signal SPWM-G(n) of FIG. 19B is applied to the line Gn-G of FIG. 19A while the G data voltage is applied to the data line Dm, the G data voltage may pass through the Sig terminal 88 of the G sub-pixel 10-2-1, the transistor T2, the transistor T3, and the transistor T4, and be applied to the node A 91. Accordingly, the G data voltage in which a threshold voltage Vth of the transistor T3 is compensated may be set for the node A 91. The operations of other sub-pixels of FIG. 19A according to the control signals of FIG. 19B are to be sufficiently understood through the above descriptions as well.

As such, in a case that a data voltage for each of the R sub-pixel, the G sub-pixel, and the B sub-pixel is time-division-multiplexed and applied to the display panel 100 through one data line Dm, a corresponding data voltage may be applied to each sub-pixel without using the MUX circuit.

In the embodiment in which the MUX circuit is not used as described above, a data voltage may be applied to each type of sub-pixel through a separate gate line, and thus coupling of parasitic capacitance between Sig terminals of the R sub-pixel, the G sub-pixel, and the B sub-pixel does not occur (for example, a behavior that a sum of brightnesses of the R sub-pixel, the G sub-pixel, and the B sub-pixel in a case that the R sub-pixel, the G sub-pixel, and the B sub-pixel are separately operated, and a pixel brightness at the time of implementing a white (W) color are different from each other does not occur). Additionally, a color shift phenomenon becomes intensified in a case of a low or intermediate gradation, in comparison to the case of a high gradation, and the behavior described above with reference to FIG. 15B also does not occur.

The case that the control signals and the data voltages are applied to the display panel in order of R, G, and B has been described above by way of example, but this is only an example, and the order may vary depending on an implementation example.

Figure 19C:
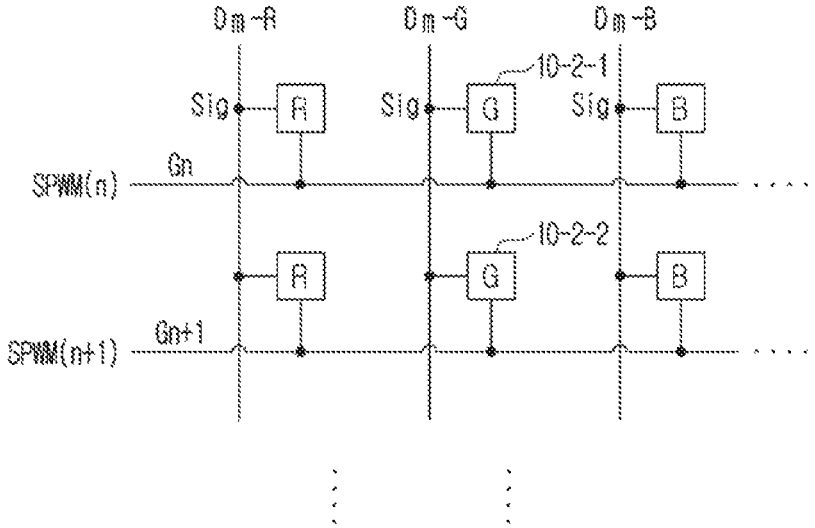
FIG. 19C is a diagram showing a part of a display panel that does not include a MUX circuit according to another embodiment.

As described above with reference to FIG. 13, according to another embodiment, a separate data line may be used for each of the R sub-pixel, the G sub-pixel, and the B sub-pixel without using the MUX circuit as shown in FIG. 19C.

Figure 20:
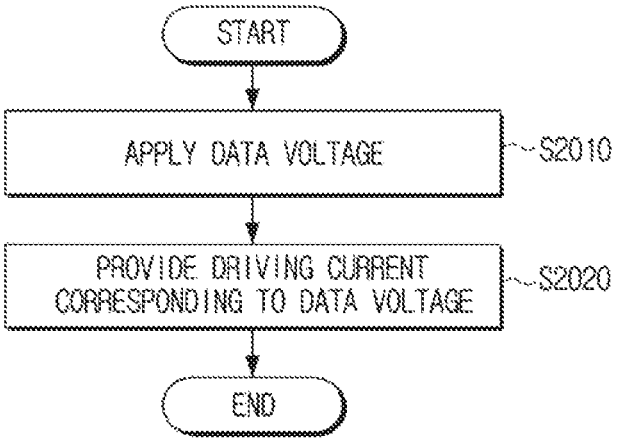
FIG. 20 is a flowchart showing a driving method of a display module according to an embodiment.

FIG. 20 is a flowchart showing a driving method of a display module 300 according to an embodiment. In describing FIG. 20, an overlapping description will be omitted.

Referring to FIG. 20, the display module 300 may apply a PAM data voltage and a PWM data voltage to a pixel circuit 110 (S2010), and provide, to an inorganic light emitting element 120, a driving current having an amplitude corresponding to the PAM data voltage and a pulse width corresponding to the PWM data voltage (S2020).

The display module 300 may include a display panel 100 including the inorganic light emitting element 120, the pixel circuit 110 providing the driving current to the inorganic light emitting element 120, and a driver 200 driving the pixel circuit 110.

Further, the pixel circuit 110 may include a PAM circuit 112 for controlling the amplitude of the driving current based on the PAM data voltage, and a PWM circuit 111 for controlling the pulse width of the driving current based on the PWM data voltage. The driver 200 may include a power supply circuit which provides, to the PAM circuit 112, a first power supply voltage for driving the PAM circuit 112, and provides, to the PWM circuit 111, a second power supply voltage for driving the PWM circuit 111.

The second power supply voltage may be lower than the first power supply voltage. Further, the power supply circuit may be provided on a board separate from the display panel 100, and may provide the first power supply voltage to the PAM circuit 112 through a first line, and provide the second power supply voltage to the PWM circuit 111 through a second line.

In the display panel 100, a plurality of pixels each including a plurality of sub-pixels may be arranged in a matrix form on a glass substrate, each of the plurality of sub-pixels may include the inorganic light emitting element 120 and the pixel circuit 110, and the inorganic light emitting element 120 may be mounted on the pixel circuit formed on the glass substrate to be electrically connected to the pixel circuit.

Further, the driver 200 may further include a gate driver circuit for driving the pixels arranged in a matrix form in a unit of row.

The inorganic light emitting element 120 may be a micro LED having a size of 100 micrometers or less.

Although FIGS. 7A, 10A, 11, and 12 each show an example in which the pixel circuit 110 is implemented by a P-type TFT, it is a matter of course that various embodiments described above may be applied to an N-type TFT as well.

Further, in various embodiments of the disclosure described above, the TFT included in the TFT layer (or TFT backplane) is not limited to a specific structure or a specific type. That is, the TFT in various examples of the disclosure may be implemented by a low temperature polysilicon (LTPS) TFT, an oxide TFT, a polysilicon or a-silicon TFT, an organic TFT, a grapheme TFT, or the like, or only a P-type (or N-type) MOSFET may be produced in a Si wafer CMOS process and applied.

As described above, according to various embodiments, a wavelength of light emitted from an inorganic light emitting element included in a display panel may not change based on a change in gradation. Further, a smudge or color of the inorganic light emitting element included in the display panel may not occur. Further, in a case that module-type display panels are combined to configure a large display panel, a brightness difference or a color difference between the module-type display panels may not occur. Further, a more optimized design of the driving circuit, thereby enabling more stable and efficient driving of the inorganic light emitting element, and reducing the size and weight of the display panel may be provided. In addition, a HDR in a unit desired by a developer may be provided.

Various embodiments may be implemented by software including instructions stored in a machine-readable storage medium (for example, a computer-readable storage medium). Here, the machine is an apparatus that may invoke a stored instruction from a storage medium and may be operated according to the invoked instruction. The machine may include the display apparatus 1300 according to the disclosed embodiments.

In the case that the instruction is executed by the processor, the processor may directly perform a function corresponding to the instruction or other components may perform the function corresponding to the instruction under a control of the processor. The instruction may include codes created or executed by a compiler or an interpreter. The machine-readable storage medium may be provided in a form of a non-transitory storage medium. Here, the term "non-transitory" means that the storage medium is tangible without including a signal, and does not distinguish whether data is semi-permanently or temporarily stored on the storage medium.

In addition, according to an embodiment, the methods according to the various embodiments of the disclosure may be included and provided in a computer program product. The computer program product may be traded as a product between a seller and a purchaser. The computer program product may be distributed in a form of a storage medium (for example, a compact disc read only memory (CD-ROM)) that may be read by the machine or online through an application store (for example, PlayStore™). In a case of the online distribution, at least a part of the computer program product may be at least temporarily stored in a storage medium such as a memory of a server of a manufacturer, a server of an application store, or a relay server or be temporarily created.

In addition, each component (for example, modules or programs) according to the various embodiments may include a single entity or a plurality of entities, and some of the corresponding sub-components described above may be omitted or other sub-components may be further included in the various embodiments. Alternatively or additionally, some of the components (for example, the modules or the programs) may be integrated into one entity, and may perform functions performed by the respective corresponding components before being integrated in the same or similar manner. Operations performed by the modules, the programs, or other components according to the various embodiments may be executed in a sequential manner, a parallel manner, an iterative manner, or a heuristic manner, at least some of the operations may be performed in a different order or be omitted, or other operations may be added.

While various embodiments have been illustrated and described with reference to various embodiments, the disclosure is not limited to specific embodiments or the drawings, and it will be understood by those of ordinary skill in the art that various changes in form and details may be made therein without departing from the spirit and scope of the disclosure, including the appended claims and their equivalents.

What is claimed is:

1. A display module comprising:

a display panel comprising an inorganic light emitting element and a pixel circuit configured to provide a driving current to the inorganic light emitting element; and a driver configured to drive the pixel circuit, wherein the pixel circuit comprises a pulse amplitude modulation (PAM) circuit configured to control an amplitude of the driving current based on an applied PAM data voltage, and a pulse width modulation (PWM) circuit configured to control a pulse width of the driving current based on an applied PWM data voltage, wherein the driver comprises a power supply circuit configured to provide, to the PAM circuit, a first power supply voltage for driving the PAM circuit, and provide, to the PWM circuit, a second power supply voltage for driving the PWM circuit, wherein the power supply circuit is configured to provide the first power supply voltage to the PAM circuit through a first line, and provide the second power supply voltage to the PWM circuit through a second line different from the first line, wherein the first power supply voltage is higher than a ground voltage, and wherein the second power supply voltage is lower than the first power supply voltage and higher than the ground voltage.

2. The display module as claimed in claim 1, wherein the power supply circuit is provided on a board separate from the display panel.

3. The display module as claimed in claim 1, wherein the display panel further comprises a plurality of pixels each comprising a plurality of sub-pixels, and wherein the plurality of pixels are arranged in a matrix form on a glass substrate, each of the plurality of sub-pixels comprises an inorganic light emitting element and a pixel circuit, and each inorganic light emitting element is provided on and electrically connected to a pixel circuit of a respective sub-pixel.

4. The display module as claimed in claim 3, wherein the driver further comprises a gate driver circuit configured to drive the pixels arranged in the matrix form in a unit of row, and a source driver circuit configured to apply the PAM data voltage or the PWM data voltage to each of the pixels or each of the sub-pixels.

5. The display module as claimed in claim 1, wherein the display panel further comprises a plurality of pixels each comprising a plurality of sub-pixels, wherein each of the plurality of pixels is disposed in each of a plurality of regions formed by intersections between a plurality of data lines to which the PWM data voltage is applied and a plurality of gate lines for selecting the plurality of pixels for each line, and wherein the driver is configured to apply a first control signal to a gate line of the plurality of gate lines for selecting a plurality of pixels connected to the gate line and sequentially apply a plurality of second control signals respectively to each the plurality of sub-pixels connected to the gate line to apply a corresponding PWM data voltage to each of the plurality of sub-pixels connected to the gate line.

6. The display module as claimed in claim 5, wherein the driver is configured to apply the first control signal after sequentially applying the plurality of second control signals to the plurality of sub-pixels connected to the gate line, to apply the corresponding PWM data voltage to each of the plurality of sub-pixels connected to the gate line.

7. The display module as claimed in claim 5, wherein the driver is configured to sequentially apply the plurality of second control signals to the plurality of sub-pixels connected to the gate line while the plurality of pixels connected to the gate line are selected based on the first control signal to apply the corresponding PWM data voltage to each of the plurality of sub-pixels connected to the gate line, and collectively apply the plurality of second control signals to the plurality of sub-pixels connected to the gate line to apply a reset data voltage.

8. The display module as claimed in claim 5, wherein the driver is configured to sequentially apply the plurality of second control signals to the plurality of sub-pixels connected to the gate line while the plurality of pixels connected to the gate line are selected based on the first control signal, to apply the corresponding PWM data voltage and a reset data voltage to each of the plurality of sub-pixels connected to the gate line.

9. The display module as claimed in claim 5, wherein the plurality of pixels each comprise an R sub-pixel, a G sub-pixel, and a B sub-pixel, wherein the plurality of second control signals comprise first to third MUX signals for sequentially selecting the R sub-pixel, the G sub-pixel, and the B sub-pixel, wherein the power supply circuit is configured to provide PWM data voltages corresponding to the R sub-pixel, the G sub-pixel, and the B sub-pixel, respectively, sequentially to a data signal line of the R sub-pixel, a data signal line of the G sub-pixel, and a data signal line of the B sub-pixel based on to the first to third MUX signals, and wherein a voltage of the data signal line of each of the R sub-pixel, the G sub-pixel, and the B sub-pixel is in a reset state while the PWM data voltage is applied to data signal lines of other sub-pixels.

10. A driving method of a display module comprising a display panel, the display panel comprising an inorganic light emitting element and a pixel circuit configured to provide a driving current to the inorganic light emitting element, and a driver configured to drive the pixel circuit, the driving method comprising:

applying a pulse amplitude modulation (PAM) data voltage and a pulse width modulation (PWM) data voltage to the pixel circuit; and providing, to the inorganic light emitting element, a driving current having an amplitude corresponding to the PAM data voltage and a pulse width corresponding to the PWM data voltage, wherein the pixel circuit comprises a PAM circuit for controlling the amplitude of the driving current based on the PAM data voltage, and a PWM circuit for controlling the pulse width of the driving current based on the PWM data voltage, wherein the driver comprises a power supply circuit that provides, to the PAM circuit, a first power supply voltage for driving the PAM circuit, and provides, to the PWM circuit, a second power supply voltage for driving the PWM circuit, wherein the power supply circuit provides the first power supply voltage to the PAM circuit through a first line, and provides the second power supply voltage to the PWM circuit through a second line different from the first line, wherein the first power supply voltage is higher than a ground voltage, and wherein the second power supply voltage is lower than the first power supply voltage and higher than the ground voltage.

* * * * *